US012290107B2

(12) United States Patent
Krietzman

(10) Patent No.: US 12,290,107 B2
(45) Date of Patent: May 6, 2025

(54) CHILD RESISTANT VAPORIZER TIPS AND DEVICES

(71) Applicant: Mark Krietzman, Palos Verdes Estates, CA (US)

(72) Inventor: Mark Krietzman, Palos Verdes Estates, CA (US)

( * ) Notice: Subject to any disclaimer, the term of this patent is extended or adjusted under 35 U.S.C. 154(b) by 379 days.

(21) Appl. No.: 17/888,924

(22) Filed: Aug. 16, 2022

(65) Prior Publication Data

US 2022/0386700 A1 Dec. 8, 2022

Related U.S. Application Data

(63) Continuation-in-part of application No. 16/457,312, filed on Jun. 28, 2019, now Pat. No. 11,457,667.

(60) Provisional application No. 63/346,964, filed on May 30, 2022, provisional application No. 63/310,584, filed on Feb. 16, 2022, provisional application No. 62/698,422, filed on Jul. 16, 2018, provisional application No. 62/691,609, filed on Jun. 29, 2018.

(51) Int. Cl.
*A24F 40/49* (2020.01)
*A24F 40/42* (2020.01)
*A24F 40/485* (2020.01)

(52) U.S. Cl.
CPC ..... *A24F 40/49* (2020.01); *A24F 40/485* (2020.01)

(58) Field of Classification Search
CPC ..... A24F 40/49; A24F 40/485; A24F 40/42; A24F 40/10
See application file for complete search history.

(56) References Cited

U.S. PATENT DOCUMENTS 11,007,546 B2 * 5/2021 Hohmann ..... B05B 11/1077
2002/0179179 A1 * 12/2002 Volpenheim ..... B65D 50/046 141/381
2005/0072792 A1 * 4/2005 Harrold ..... B65D 47/126 222/48
2009/0095700 A1 * 4/2009 Carroll ..... B65D 50/04 215/211
2010/0096354 A1 * 4/2010 DeJonge ..... B65D 41/06 215/218
2013/0214004 A1 * 8/2013 Dejonge ..... B65D 50/061 220/345.3
2013/0218066 A1 * 8/2013 Duquet ..... A45D 34/04 604/20
2014/0097207 A1 * 4/2014 Szymiczek ..... A61M 15/0001 222/153.13
2015/0284177 A1 * 10/2015 Patil ..... B65D 83/22 222/153.04
2015/0306617 A1 * 10/2015 Olegnowicz ..... B05B 11/1047 222/1
2017/0360092 A1 * 12/2017 Althorpe ..... A61M 15/06
(Continued)

*Primary Examiner* — Abdullah A Riyami
*Assistant Examiner* — Thang H Nguyen
(74) *Attorney, Agent, or Firm* — Mark H. Krietzman

(57) ABSTRACT

Methods and systems to control, limit or stop vapor flow through a vaporizer cartridge and tip. A vapor barrier blocking member affixed to a vapor source and having flexible walls are at rest unless displaced by sufficient predetermined force to unblock a blocked a vapor outlet. Said vapor barrier is attached to a cartridge or device whereby most children under a predetermined chronological age cannot apply sufficient force to remove the vapor barrier nor sufficient force to open the valve in the barrier.

15 Claims, 21 Drawing Sheets

(56) References Cited

U.S. PATENT DOCUMENTS

| | | | | |
|---|---|---|---|---|
| 2018/0030974 | A1* | 2/2018 | Cosgarea | F04B 39/122 |
| 2018/0140001 | A1* | 5/2018 | Gabbay | A24B 15/167 |
| 2020/0138117 | A1* | 5/2020 | Rosser | A61M 15/003 |
| 2020/0156826 | A1* | 5/2020 | Kilduff | B65D 43/162 |
| 2020/0156831 | A1* | 5/2020 | Tapocik | B65D 35/38 |
| 2020/0377280 | A1* | 12/2020 | Pace | B65D 51/18 |

* cited by examiner

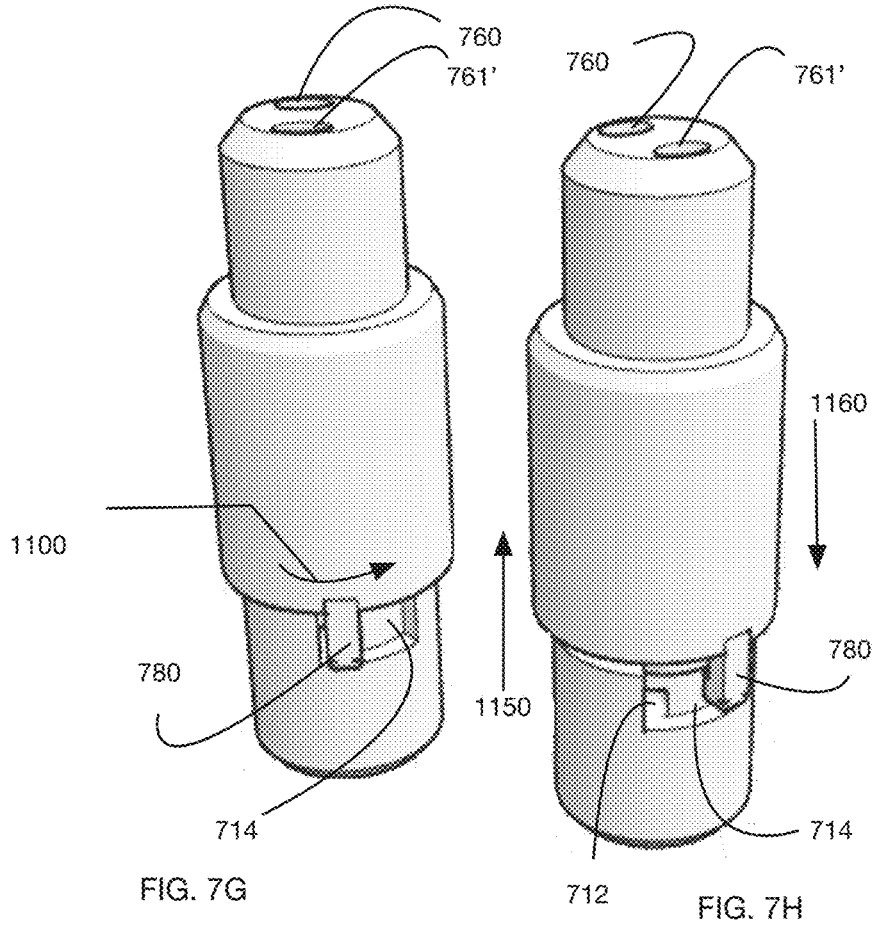
FIG. 7G
FIG. 7H
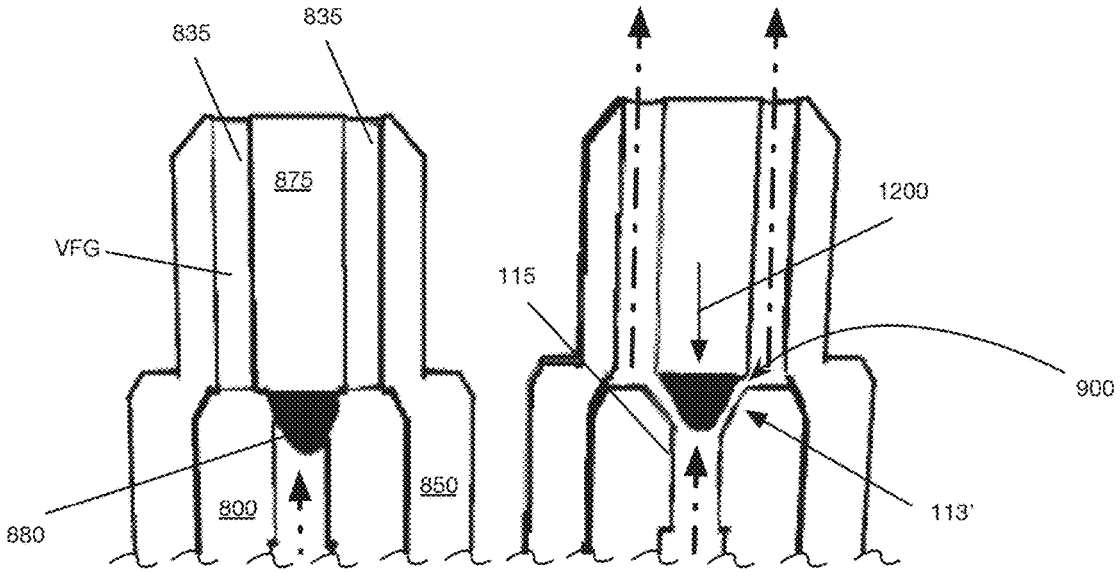
FIG. 8

CHILD RESISTANT VAPORIZER TIPS AND DEVICES

RELATED APPLICATION

This Continuation-in-Part Application claims the benefit of Applicant's U.S. Provisional patent application 63/346,964 filed May 30, 2022, entitled "Child Resistant Vaporizer Tips and Devices" and Applicant's U.S. Provisional patent application 63/310,584 filed Feb. 16, 2022, entitled "Child Resistant Vaporizer Devices". This application also claims the benefit of Applicant's U.S. patent application Ser. No. 16/457,312 filed Jun. 28, 2019 "CHILD RESISTANT VAPORIZER DEVICES" which claimed the benefit of Applicant's U.S. Provisional Patent Application Ser. No. 62/691,609 filed Jun. 29, 2018 "TAMPER RESISTANT VAPORIZER DEVICES" and 62/698,422 filed Jul. 16, 2018 entitled "SAFER VAPORIZER DEVICES" and U.S. Patent application Ser. No. 63/310,584 filed Feb. 16, 2022 "CHILD RESISTANT VAPORIZER DEVICES" the entirety of each is incorporated by reference herein in as if set forth in their entirety.

BACKGROUND OF THE DISCLOSURE

Field of the Disclosure

The present disclosure relates generally to preventing and control of fluid flow through a vaporizer cartridge.

Related Art

Vaporizers for many essential oils have become common place. The range of aromatherapy oils is very large with different oils vaporizing at different temperatures. These devices may be a simple as inhale and a battery supply immediately heats a coil or other heating element to heat the oil and produce vapor. Other device may require a sequence of button pushing or switch flipping.

*Cannabis* extracted oils are also commonly found in such cartridges. *Cannabis sativa* contains over 421 different chemical compounds, including over 60 cannabinoids. Cannabinoid plant chemistry is far more complex than that of pure THC, and different effects may be expected due to the presence of additional cannabinoids and other chemicals. Eighteen different classes of chemicals, including nitrogenous compounds, amino acids, hydrocarbons, carbohydrates, terpenes, and simple and fatty acids, contribute to the known pharmacological properties of *Cannabis*.

*Cannabis*, for example has a narrow range at which it can be heated to release "THC" (Tetrahydrocannabinol (THC), or more precisely its main isomer (−)-trans-$\Delta^9$-tetrahydrocannabinol) and CBDs (Cannabidiol loosely referring to as many as 85 identified compounds in *Cannabis*) chemicals as vapor without burning the organic material and adding non-THC and CBD material to the inhalation gases.

Children are curious and will imitate adult use or simple explore. It is therefore a desideratum to have child resistant vaporizer.

DISCLOSURE

In the following description of examples of implementations, reference is made to the accompanying drawings that form a part hereof, and which show, by way of illustration, specific implementations of the present disclosure that may be utilized. Other implementations may be utilized and structural changes may be made without departing from the scope of the present disclosure.

Vaporizer batteries, control circuits and the like are known. This disclosure should be interpreted broadly and is a mechanical solution for a plethora of vaporizer devices to discourage, frustrate or prevent child use. Title 16 of the Code of Federal Rules (CFR) 1700.15 describes safety packaging for poisons and the need for child resistant packaging. That governmental code is hereby referenced and incorporated by this reference as if fully set forth herein. In relevant part is sets standards to prevent accidental or misuse by children. It also has specific guideline for aerosols.

Aspects of a tamper resistant vaporizer cartridge include a method of selective blocking and unblocking vapor flow through a tip, the method controls vapor output of a vaporizer cartridge through a fluidly connected tip by blocking said vapor flow. Cartridges are configured to mate with a power supply at a first end and have a vapor pathway at a second end; the vapor pathway is configured to mate with a tip having a proximal end, a distal end and a vapor outlet therethrough forming a fluid pathway from the vapor outlet to the vapor pathway; opening the fluid pathway through the tip by moving a vapor blocking cap axially from the second end towards the vapor blocking cap's top thereby displacing one or more flexible fingers formed at the distal end of the cap over a radial interference member (formed on the tip to remove the vapor blocking cap from the tip; and, wherein the one or more flexible fingers formed on the vapor blocking cap is configured to rest below the radial interference member; and, wherein a predetermined force is required to displace the finger over the interference member.

The tip is a control means for a vaporizer cartridge which is configured to receive power from a power supply at a first end and with a vapor pathway at a second tip connection. For a disposable vaporizer system the battery power supply and cartridge may be an integrated unit. The control tips and vapor barriers taught herein are equally applicable for such an integrated unit and such a unit is anticipated hereby. A wide variety of vaporizer configuration exist and it is not possible nor required to detail every possible configuration of same in this disclosure. Those of ordinary skill in the art will recognize the tip control of vapor flow as being applicable to same.

Aspects of a tamper resistant vaporizer cartridge include a device and method of selective blocking and unblocking vapor flow through a tip, the method involving selective blocking and unblocking vapor flow through a tip. The tip is the outlet end of a pen style vaporizer. The vaporizer provides power to a cartridge thereby heating an extract and producing vapor. Aspects of tips having a body, top end, bottom end and flexible side walls surrounding a fluid pathway are taught. IN some instances the cartridge may have a cover or cap which provides fluid connection or apertures from the cartridge to the user. In a soft or flexible tip at least a portion of the tip or vapor barrier is made of the pliant or soft material. A first half pathway is formed which is fluidly connected to a vapor outlet through the distal end of the tip and a second half pathway is fluidly connected to an inhalation outlet. A valve passage is formed of a deformable wall region that is flat at rest (and therefore not open) forming a valve in a sealed state; and, whereby squeezing the side walls of the soft tip portion of the vapor barrier with a predetermined force deforms and opens the valve thereon allowing vapor produced by a cartridge fluidly connected to the tip will flow through the first and second half pathways. The predetermined force should be a force that is too great for at least ninety percent of five-year-old to overcome. More preferably the predetermined force is a force that is too great for at least ninety-five percent of five-year-old to overcome.

Aspects of a tamper resistant vaporizer cartridge include a device and method of selective blocking and unblocking vapor flow through a tip are disclosed. A vaporizer cartridge configured to receive power from a power supply and with a vapor pathway and connection is connected to a valve tip via the connection. The valve tip has a body has a proximal end with an outlet fluidly connected to a valved pathway, at least one force limiting rib (FLR), a valve stem guide and a series of fluid connections therethrough. The distal end of the tip has a vapor outlet (130) connected to the outlet. A valve stem is configured to shut on and off vapor flow through the tip. The valve stem has an elongated body, a stem proximal head, a distal stem end, a valve connect configured to mate within the stem guide and block the fluid pathway in a first configuration and unblock the fluid pathway in a second configuration. The stem proximal head which is limited from turning to align the valve connect to the second configuration by the at least one FLR; and the stem proximal head can be turned past the FLR be a predetermined amount of rotational force or torque.

The predetermined force is a force that is too great for at least ninety percent of five-year-old to overcome. Preferably the predetermined force is a force that is too great for at least ninety-five percent of five-year-old to overcome.

Aspects of a tamper resistant vaporizer cartridge include a device and method of selective blocking and unblocking vapor flow through a tip are disclosed. A vaporizer cartridge configured to receive power from a power supply and with a vapor pathway and connection is connected to a valve tip via the connection. The tip has a vapor outlet formed therethrough, a proximal end and a distal end. The distal end is configured to be in fluid communication via the vapor outlet with the cartridge vapor pathway. A fluid pathway through the tip is opened and closed by moving a vapor blocking cap axially from the second end towards the vapor blocking cap's top thereby displacing one or more flexible fingers formed at the distal end of the cap over a radial interference member formed on the tip to remove the vapor blocking cap from the tip. Wherein the one or more flexible fingers formed on the vapor blocking cap is configured to rest below the radial interference member and, wherein a predetermined force is required to displace the finger over the interference member.

Aspects of a tamper resistant vaporizer cartridge include a device and method of selective blocking and unblocking vapor flow through a tip are disclosed. A vaporizer cartridge configured to receive power from a power supply and with a vapor pathway and connection is connected to a valve tip via the connection. The tip has a series of outlets formed therethrough configured to selectively be in fluid communication. The tip has a proximal end with an outlet and a distal end to form a fluid pathway from the cartridge to the tip. The second end forming a fluid pathway from the vapor outlet to the vapor pathway. The opening of the fluid pathway through of the tip is accomplished by pulling a barrier cap axially from the second end towards the top of the barrier cap thereby displacing one or more flexible fingers formed at the distal end of the barrier cap from a first at rest position in a first catch over an interference member and into a second position in a second catch thereby unblocking the outlet by moving a plunger extending downward axially from the barrier cap top and within the barrier cap from blocking the outlet. Unblocking the outlet allows vapor to flow through the vapor flow guide (VFG) formed by the barrier cap and be drawn out of one or more inhalation ports. A predetermined force is required to displace the finger over the interference member thereby limiting access to the vapor for persons such as children who lack the strength or dexterity to move the barrier cap.

In some instances the predetermined force is a force that is too great for at least ninety percent of five-year-old to overcome. In some instances the predetermined force is a force that is too great for at least ninety-five percent of five-year-old to overcome. In some instances the second catch has at least one shaped surface configured to prevent removal of the at least one flexible finger by the force necessary to move the fingers from the first catch over the interference member and into the second catch. To close the flow of vapor the method involves pressing on the barrier cap towards the distal end of the vaporizer cartridge wherein the fingers move from the second catch to the first catch and block the fluid pathway.

Aspects of a tamper resistant vaporizer cartridge include a device and method of selective blocking and unblocking vapor flow through a tip are disclosed. A vaporizer cartridge configured to receive power from a power supply and with a vapor pathway and connection is connected to a valve tip via the connection. The tip has a series of outlets cooperating to selectively form a blockable fluid pathway. A tip having a vapor outlet, proximal end with an outlet and a distal end connect to the second end (which produces a vapor stream upon heating) of a cartridge, that connection forms a fluid pathway from the vapor outlet to the vapor pathway. Opening the fluid pathway through of the tip is accomplished by rotating a control cap displacing one or more flexible feet formed at the distal end of the control cap from a first at rest position in a deep catch formed in the tip and into a second position on a shallow catch and pulling the valve cap upward towards its top thereby unblocking the outlet by moving a plunger extending downward axially from the control cap top and within the control cap from blocking the outlet. Accordingly, vapor can flow through the cap and be drawn out of one or more inhalation ports. In some instances a predetermined force is required to displace the one or more feet from the deep catch.

To limit use by children of the above-described devices in some instances the predetermined force is a force that is too great for at least ninety percent of five-year-old to overcome. To limit use by children of the above-described devices in some instances the predetermined force is a force that is too great for at least ninety-five percent of five-year-old to overcome.

In some instances to close the vapor flow through the tip the user or operator rotates the cap in reverse and said rotation directs the feet and toes back into the deep catch wherein the one or more feet move from the shallow catch to the deep catch and moves the plunger to block the fluid pathway.

Aspects of a tamper resistant vaporizer cartridge include a device and method of selective blocking and unblocking vapor flow through a tip are disclosed. A vaporizer cartridge configured to receive power from a power supply and with a vapor pathway and connection is connected to a valve tip via the connection. The tip has a vapor outlet, a proximal end with an outlet and a distal end and a first catch formed radially around the distal end of the tip. Adjacent to the first catch is a second catch formed radially around the distal end of the tip. An interference member is formed between the first and second catches configured to cooperate with the flexible legs of the cap to provide force control. A barrier cap configured to mount over the tip in a movable fashion has a top and a distal end. A plunger which is used to control vapor flow extends downward axially from the top within the barrier cap. At least one flexible leg formed at the distal end of the barrier cap configured to latch with the catches. The fluid pathway for vapor is opened through the barrier cap from the tip through one or more inhalation ports when the cap is raised from one catch to another and closed off by the reverse movement of legs in catches. A predetermined force is required to displace the leg over the interference member.

FIGURES

The invention may be better understood by referring to the following figures. The components in the figures are not necessarily to scale, emphasis instead being placed upon illustrating the principles of the invention. In the figures, like reference numerals designate corresponding parts throughout the different views.

FIGS. 7A-7H illustrate aspects of rotating flow control tamper resistant vaporizer cartridge.

FIG. 8 illustrates aspects of flow control between a tip and cp.

FIGS. 22A-2D illustrate extending latches on a barrier which are configured to engage catches on a tip to limit movement of the barrier and/or unintended usage of a vaporizer.

All descriptions and callouts in the Figures and all content therein are hereby incorporated by this reference as if fully set forth herein.

Further Disclosure

Disclosed herein are aspects of devices, methods and systems of tamper resistant modules for an electronic vaporizer cartridge.

Figure 1:
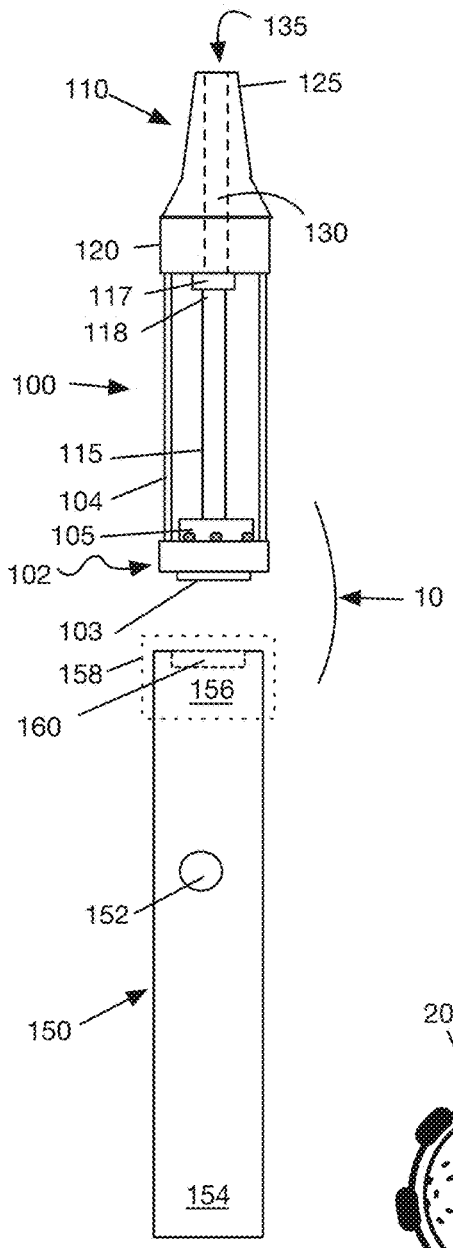
FIG. 1 is a component view of a pen type vaporizer for extract.
Figure 2A:
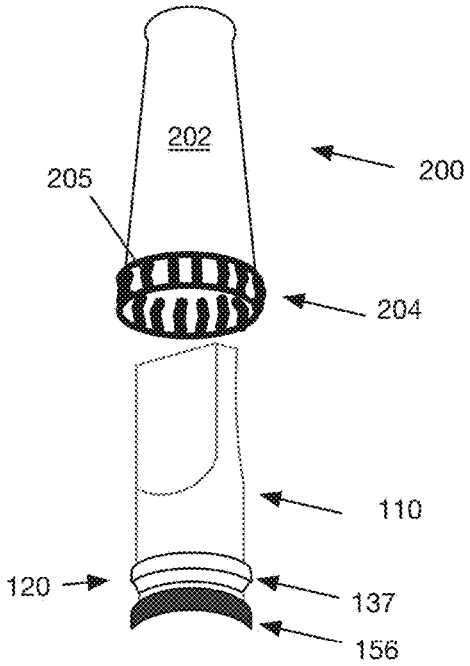
FIGS. 2A-2D illustrates aspects of a snap on tamper resistant flow control vaporizer cartridge.
Figure 2D:
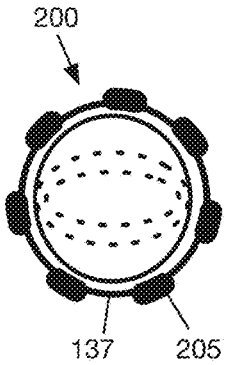
Figure 2B:
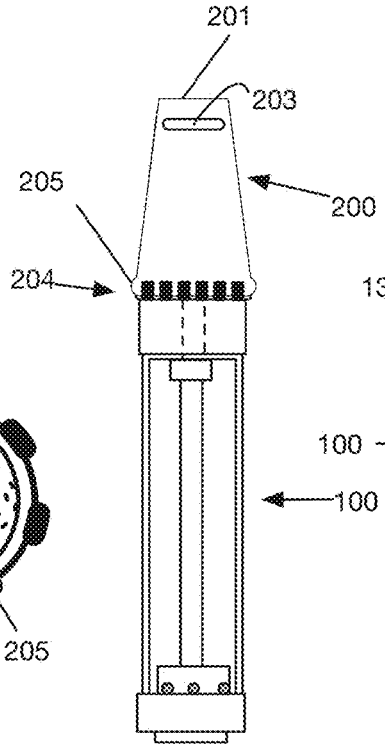
Figure 2C:
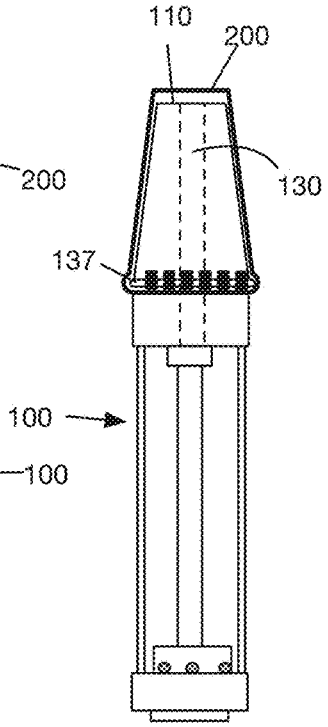

FIG. 1 illustrates a traditional vaporizer system 10 with replaceable cartridge 100. Body 150 containing a power supply and controller (not shown) has an on/off switch 152 accessible on the body a distal end 154 and a proximal end 156. A cartridge interface 158 is configured at one end to mount to the replaceable cartridge 100, in some instances the cartridge may be integrated into the Body a single unit without a removable cartridge. Cartridges are shown as linear but those of ordinary skill in the art will recognize that a squat or square cartridge with an inhalation outlet is also within the scope of this disclosure. The cartridge has a first end 102 configured to mate with the cartridge interface 158. At the first end is a power connection 103 configured to electrically connect to the power coupling 160 on the body. The interface connection may be friction fit or preferably via threaded fitting.

A tube 104 is connected to the first end on the opposite side as the power connection 103. Within the tube is an electrical heating element 105 containing a heater and connected to a vapor pathway 115 which may have a tip gasket 117 at its tip connection 118. The tip has a distal end 120 which connects with the connection end of the fluid pathway and with the tube 104 and it has a proximal end 125. A vapor inlet/pathway 130 is formed axially in the tip from the distal end to the proximal end and is configured to connect to the vapor pathway to form a fluid pathway from the cartridge heater to an inhalation port 135 at the top of the proximal end of the tip.

FIGS. 2A through 2D illustrate aspects of a snap on tamper resistant tip cover having top 201 blocking one end of a hollow body 202 forming a vapor blocking cap 200 configured to mate over the tip 110. Optionally, near the top 201 one or more of a texture, extension, bump, divot, outcropping or indentation 203 may be formed as a finger, fingernail or bite grasp. At the distal end 204 of the vapor blocking cap are one or more flexible fingers 205. The flexibility is a matter of material choice. Plastics, resins and thin metals may be used. Materials with the sufficient resiliency to form a flexible movable structure that can move radially when displaced are adequate. Some describe these materials as living hinges formed in a single molded plastic piece with adequate resiliency to move sufficient time to provide a viable tamper resistant cover for a predetermined number of attachments and removals. Spring steel, Polypropylene, polyethylene, nylon, polycarbonate, and the like may be used. The finger(s) 205 form a shaped latch configured to connect into or over a radially interference member 137 formed around the distal end 120 of the tip.

Figure 3A:
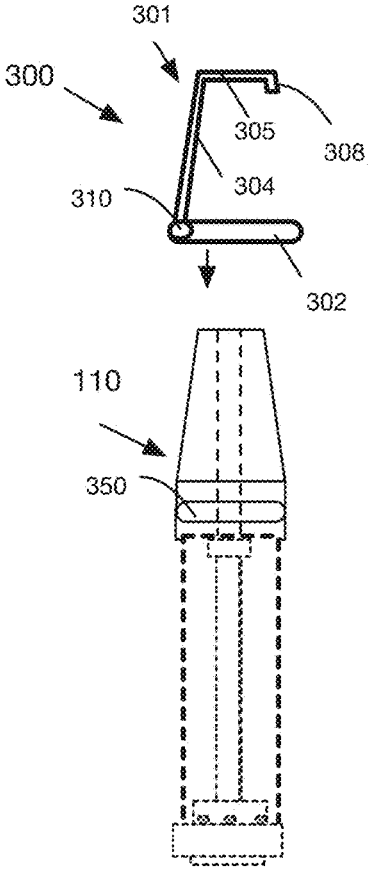
FIGS. 3A to 3C show an assembly view and a sequence of use view of a flip top tamper resistant flow control vaporizer cartridge.
Figure 3B:
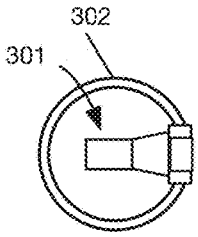
Figure 3C:
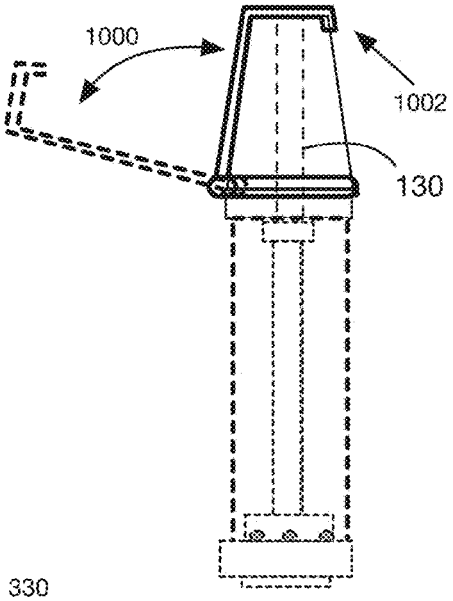

FIGS. 3A through 3C show aspects if a collared flip top 300. The flexible arm 301 is affixed to a ring-shaped collar 302 that firmly mates with an interface 350 on the tip. The mating may be pressure fit, latch and catch, sonic weld or adhesive. The collar may be a partial circle. The flexible arm has a vertical member 304 a cross member 305 and a lip 308 which are a single piece that is configured to tightly fit over the tip. A pivot 310 is formed between the flexible arm and the collar allowing rotation along the path of arrow 1000. By applying force at the lip 208 along the line of arrow 1002 the flip top 300 may be displaced from blocking the vapor inlet/pathway 130.

Figure 4:
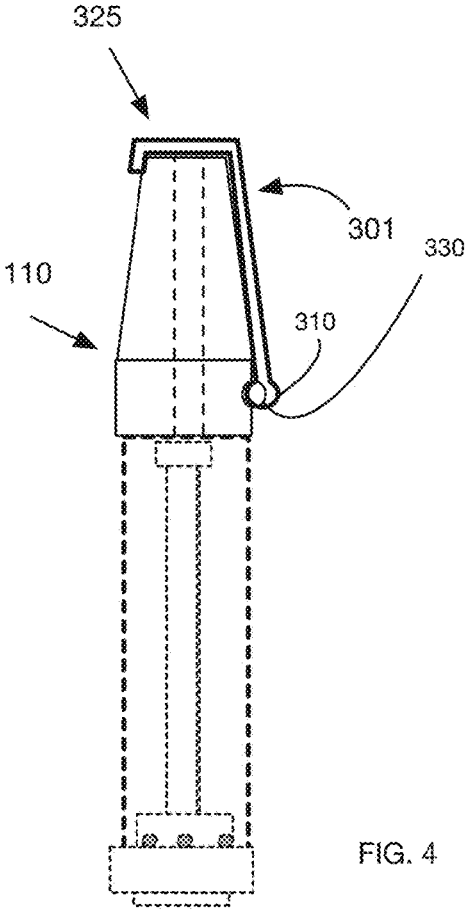
FIG. 4 show another flip top tamper resistant vaporizer cartridge.
Figure 5A:
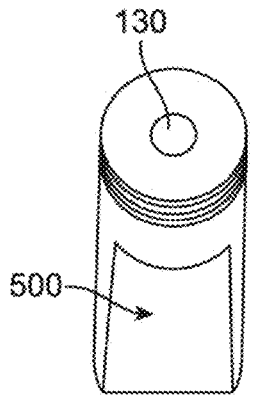
FIGS. 5A-5L illustrate aspects of latching flow control tamper resistant vaporizer cartridges.
Figure 5B:
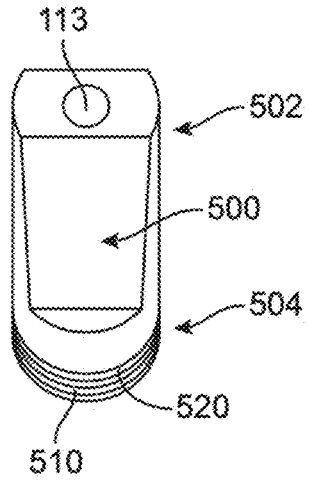
Figure 5C:
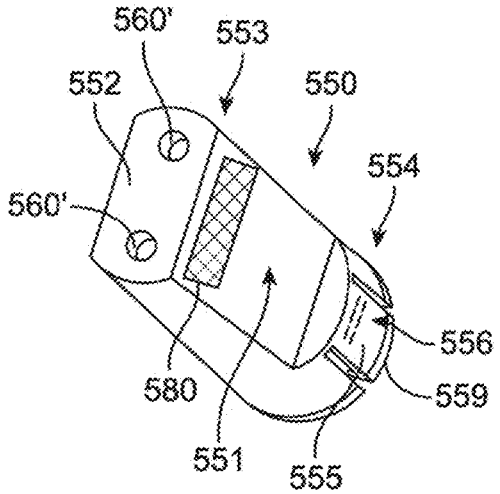
Figure 5D:
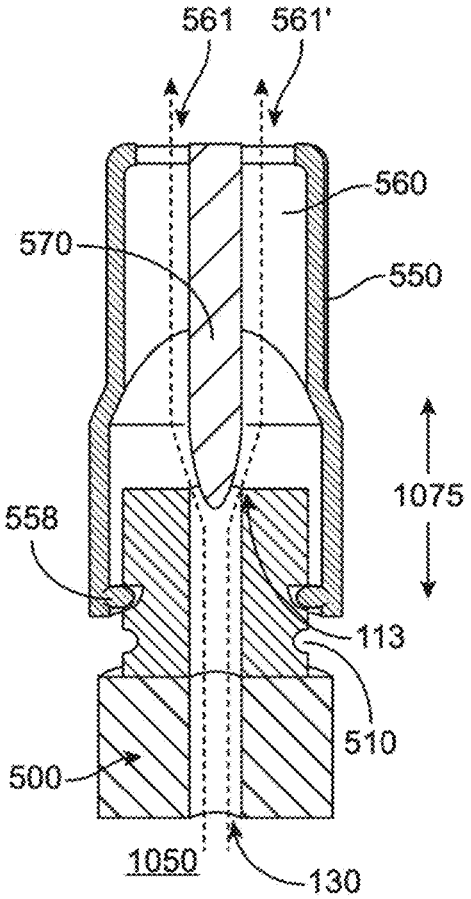
Figure 5E:
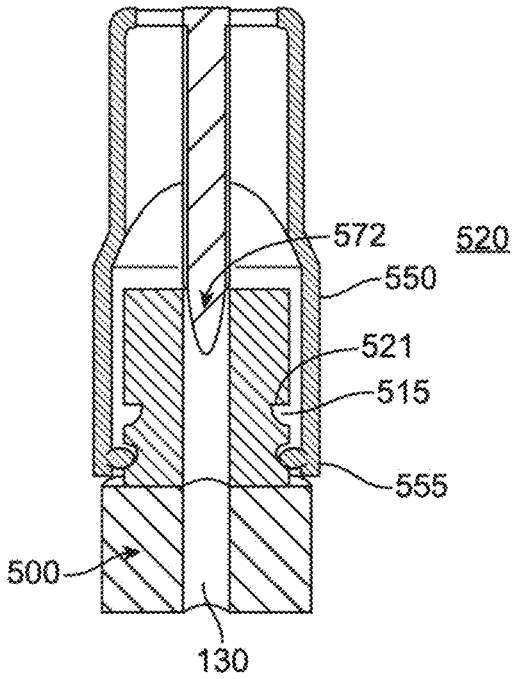
Figure 5F:
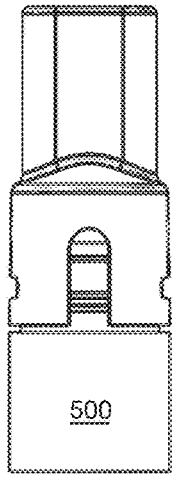
Figure 5G:
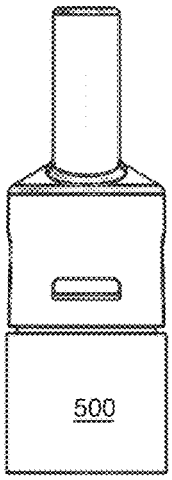
Figure 5H:
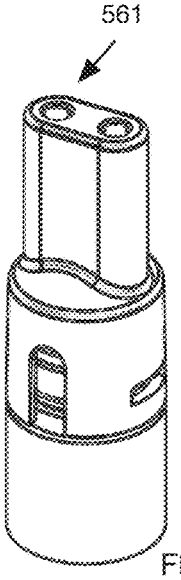
Figure 5I:
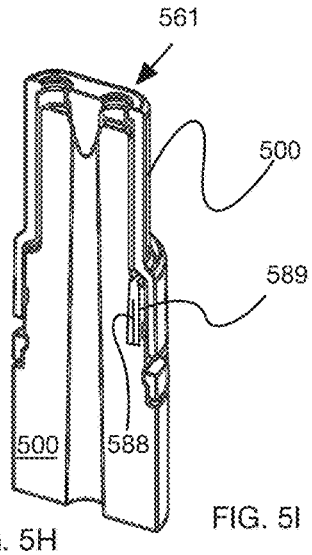
Figure 5J:
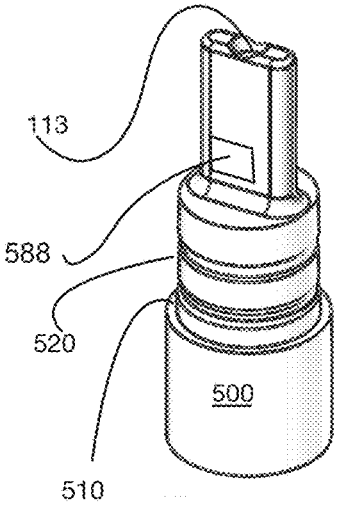
Figure 5K:
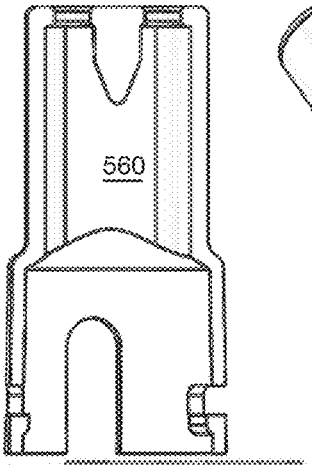
Figure 5L:
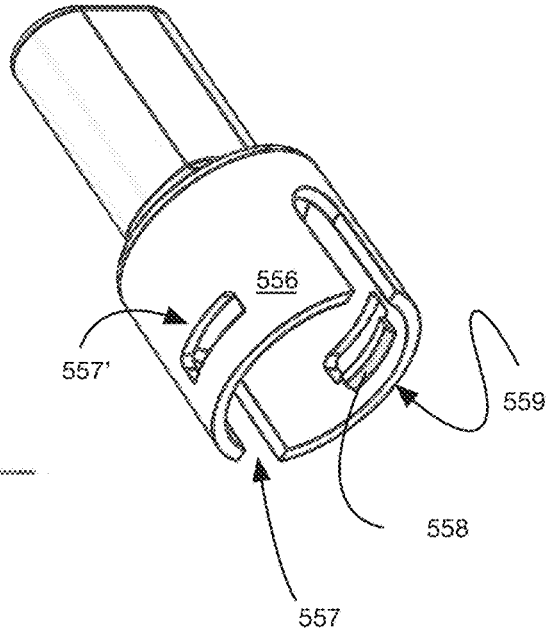

FIG. 4 shows a variation on the lip top device wherein a first portion 330 of the pivot 310 is formed as part of the tip and is configured to pressure fit into the flexible arm and the ring is eliminated.

FIGS. 5A through 5L and FIG. 6 illustrate axially extending latches on a cap which are configured to engage catches on a tip to limit movement of the cap and/or unintended usage of a vaporizer. FIGS. 5A through 5L illustrate a vapor barrier cap 550 connecting a tip 500 having a fluid vapor pathway 115 formed therethrough, a proximal end 502 with an outlet 113 and a distal end 504. The distal end configured to fluidly connect to the vapor pathway 115 of a cartridge 100 (see FIG. 1) forming a fluid pathway from the cartridge to the tip. A barrier cap 550 is a generally hollow tube body 551 and a top 552 formed as part of the cap and partially covering the proximal end 553 of the tube body partially sealing the tube. The tube body 551 forms a vapor flow guide (VFG) 560 wherein vapor from an unblocked outlet 113 will flow. The VFG terminates into at least one inhalation port 561 and 561' which form an inhalation outlet whereby vapor can flow along the line 1050. Inside the barrier cap is at least one plunger 570. The plunger is an extended leg which is configured to block the outlet 113 when moved into same. At the end of the plunger is a shaped plunger tip 572 that is configured to reversibly block said outlet.

An RFID tag or chip 588 may be added. A slot or cavity 589 for said RFID tag may be formed in one of the tip 500 or the barrier cap 550. Said RFID tag is configured to cooperate with a track and trace system for vaporizer cartridges.

The barrier cap 550 is configured to cooperate with the tip to facilitate limited movement of the barrier cap axially along the tip. Said movement requires a force that exceeds the force at least 70% of 5-year-old children can exert. More preferable exceeds the force 90% of 5-year-old children can exert and most preferably exceeds the force at least 95% of 5-year-old children can exert.

Cap Movement

From the distal end of the barrier cap extend at least one moving latch wall 556 separated by a vertical flex guide 567. Each moving latch wall 556 and finger latch 558 is configured to face the center of said barrier cap. An additional horizontal flex guide 557' may be formed in the moving latch wall 556. The depiction of the flexible finger as a small area of the distal end of the cap is not a limitation and those of ordinary skill in the art will understand that the range of flexible fingers or wall sections may be a larger or smaller. The choice of material may impact the finger dimensions to achieve a predetermined latching force. flexible finger and latch are configured to reversible latch into catches formed on the tip. A section of the wall forms a moving latch wall 556, supporting a finger latch, is configured to bend without breaking if sufficient radial force is applied to the flexible finger latch. That moving latch wall 556 may be thinner, grooved or otherwise formed to act as a living hinge. In some instances the selected thickness of the wall adjacent to the moving latch wall and regions distance from the free end 559 of the moving latch wall 556 cooperate to limit finger latch 558 movement to correspond to a predetermined amount of force being applied. The first catch 510 is an annular extended ring or indentation around the distal end 504 of the tip. A second catch 520 is formed above the first catch near to the proximal end 502 of the tip and an interference member or region 515 is between the first and second catches. That region is formed as an annular section that may be indented or extended.

In operation the latch 558 and flexible finger 555 are shaped to be at rest (not under substantial radial stress) and the first catch 510 is shaped to facilitate movement into and out of the catch in an axial and upward direction over the interference member 515 along the path of line 1075 to reach the second catch 520. The second catch 520 is shaped and configured to prevent upward movement of the latch 558. At least one shaped region 521 if the second catch forms a stop to restrict and limit removal of the barrier cap. The latch 558 may have a shape corresponding to the second catch. When the latch is in the second catch the barrier cap can normally only be moved downward along the path of arrow 1075 towards the distal end of the tip.

Vapor Blocking

The plunger 570 and plunger tip 572 formed inside the barrier cap cooperatively move along the same line as the barrier cap relative to the tip. When the barrier cap is fixed at the first catch the plunger tip block the outlet 113 of the tip. When the barrier cap is extended axially the barrier cap is lifted and the plunger no longer blocks the outlet 113. Accordingly, vapor can flow through the vapor flow guide (VFG) and exit the barrier cap via the at least one inhalation ports 561/561'. To restrict vapor flow and prevent unauthorized use by children and the like the vapor barrier cap should be moved back to the first catch position thereby blocking the outlet. Grasping features 580 such as rough areas, indentations, divots, bumps, grooves outdents and the like may be added to at least a portion of the barrier cap to facilitate gripping. The movement of the barrier cap relative to the tip requires a predetermined amount of force. In some instances the vapor barrier cap may be disposable as is the cartridge—the action of the flexible finger cooperating with the catches should provide for at least the number of use cycles said cartridge can supply. A use cycle is generally the number of consumer uses of the device. Generally speaking at least 60 movements between catch one and catch two (a cycle) for a 1 ml cartridge would be expected. More preferable about 75 cycles.

Figure 6:
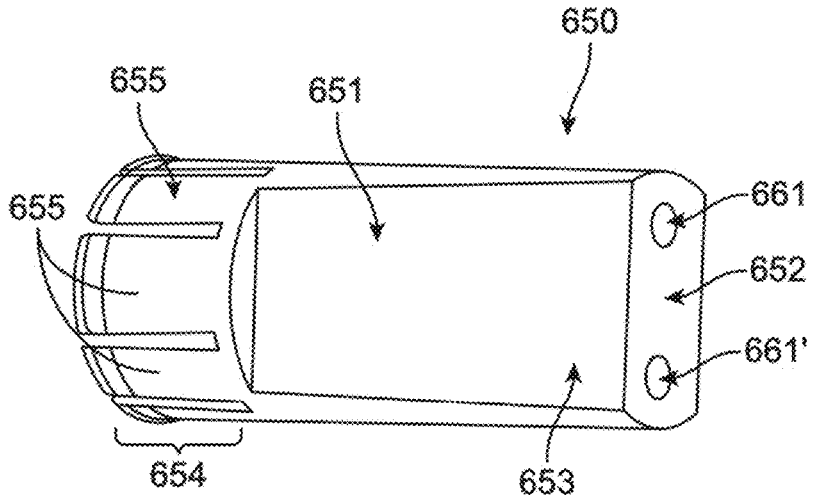
FIG. 6 illustrates aspects of a multi-latch flow control tamper resistant vaporizer cartridges.
Figure 7A:
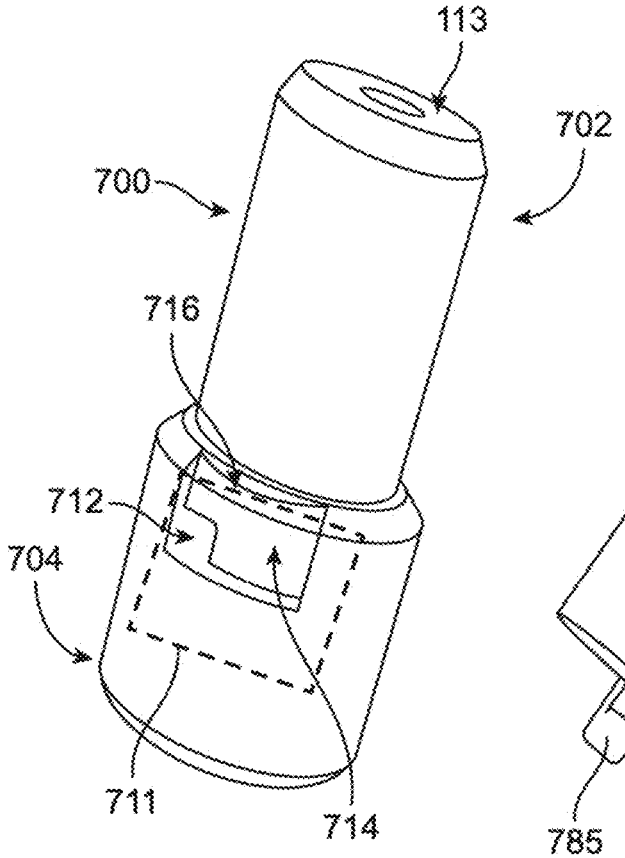
Figure 7B:
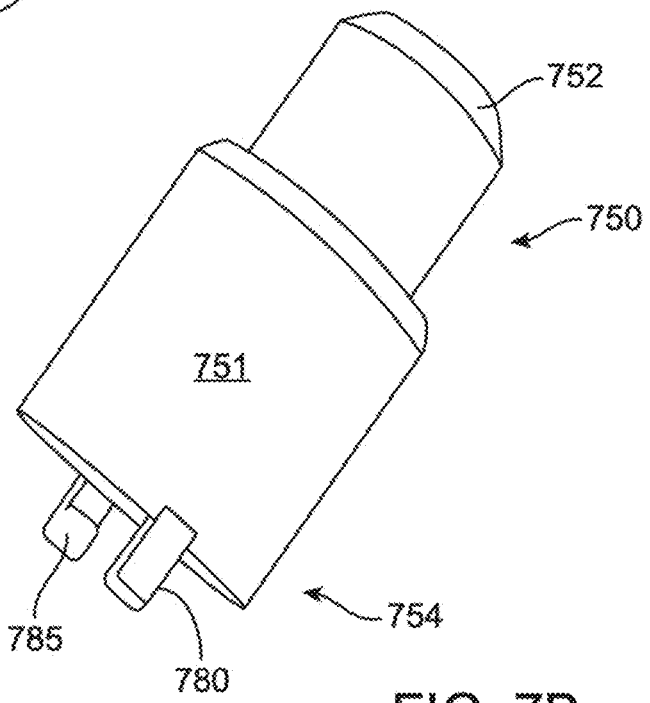
Figure 7C:
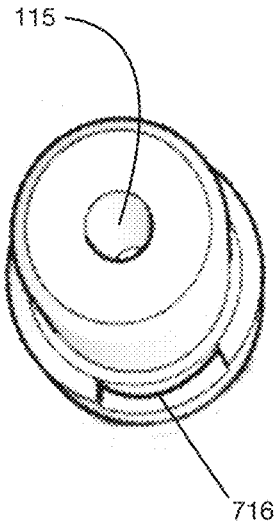
Figure 7D:
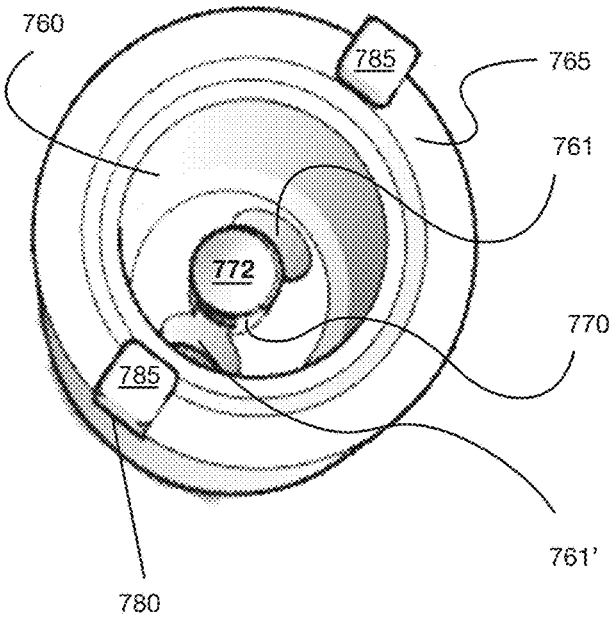
Figure 7E:
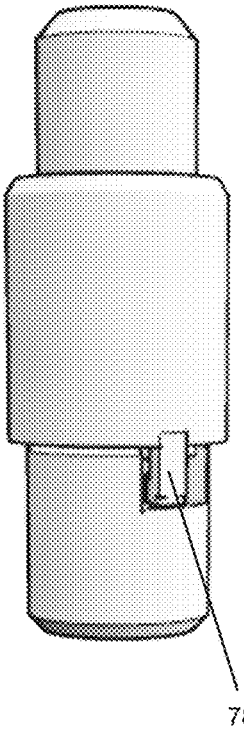
Figure 7F:
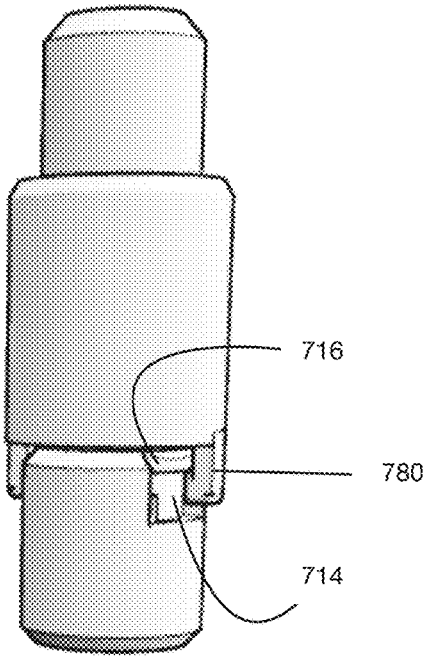

FIG. 6 illustrate another vapor barrier cap 650 configured to connect to tip 500. The multi-leg barrier cap 650 is a generally hollow tube body 651 and a top 652 over a proximal end 653 of the body partially sealing the body tube. A series of flexible finger 655 are formed around the distal end 654 of the cap. The tube body forms a vapor flow guide (VFG) wherein vapor from an unblocked outlet 113 will flow. The VFG terminates into at least one inhalation port 66*i* and 661' which form an inhalation outlet whereby said vapor can be inhaled. Inside the barrier cap is at least one plunger as described in reference to FIGS. 5A-5E and which functions as described above.

FIGS. 7A through 7H disclose a twisting vapor outlet tip 700 and a control cap 750. Axially extendable members formed as part of the cap are configured as latches to releasably engage a series of catches formed on the corresponding tip 700 thereby limiting movement of the cap and/or unintended usage of a vaporizer. The connecting tip 700 has a vapor pathway formed therethrough, a proximal end 702 with an outlet 113 and a distal end 704. The distal end is configured to mate with the tip connection end 118 of a cartridge 100 (see FIG. 1) forming a fluid pathway from the cartridge to the tip.

The control cap 750 is a generally hollow tube body 751 and a top 752 formed as part of the cap and partially covering the proximal end 752 of the tube body partially sealing the tube. The distal end 754 of the body terminates at a bottom edge 756. The tube body 751 has an inner annular wall 760 which forms a vapor flow guide (VFG) wherein vapor from an unblocked outlet 113 will flow. The VFG terminates into at least one inhalation port 761 and 761' which form an inhalation outlet whereby said vapor can flow along the line. Inside the control cap is at least one plunger 770. The plunger is an extended leg which is configured to block the outlet 113 when moved into same. At the end of the plunger is a shaped plunger tip 772 that is configured to reversibly block said outlet.

The control cap 750 is configured to cooperate with the tip to facilitate limited movement of the barrier cap axially along the tip. Said movement requires a force that exceeds the force at least 70% of 5-year-old children can apply. More preferable exceeds the force 90% of 5-year-old children can apply and most preferably exceeds the force at least 95% of 5-year-old children can apply. The control cap 750 has at least two flexible feet 780 extended from the distal end 754 of the control cap. Toe latches 785 extend inward from each of the flexible feet 780.

Cap Movement

The control cap moves radially and axially around the tip. Latches and catches formed between the toes and a series of catches and stops restrict the movement and set the force required to move the toes form one catch to another. Each toe 785 is configured to temporarily mate with catches. The catches and stop are formed in the catch section 711 of the side wall of the tip. A deep catch 712 is, as the name implies, deep. It extends inward radially further than other catches. The deep catch is configured to temporarily retain a toe 785 placed therein. The flexible feet 780 and toe 785 combination are removed from the deep catch by applying a rotational force along the line of arrow 1100. Sufficient force must be applied to the control cap to distort the flexible feet whereby the toe 785 can exit the deep well. When sufficient force is applied the toe is moved to the shallow well 714. Once in the shallow well the control cap may be lifted axially along the tip following line 1150 thereby lifting the plunger tip 772 out of the outlet 113. The shallow well extends upward closer towards the proximal end 752 of the control cap than the deep well does. At an upper boundary of the shallow catch a stop is formed and configured to inhibit removal of the control cap by prevent or limiting the toe from being displaced over it.

Vapor Flow

The fluid pathway is selectively closed and opened via the rotating and linear movement of the control cap relative to the tip. Lifting the control cap along arrow 1100 opens the fluid pathway inside the tip and cap system and allows vapor to flow from the outlet 113 into the VFG and eventually out of the at least one inhalation port. To close off vapor flow from the outlet the user reverses the steps and linearly pushes the control cap 750 downward towards the distal end of the tip 704 along the line of arrow 1160.

FIG. 8 is a cut-away showing the open—close sequence of a tip 800 and cap cover 850 combination to allow or block vapor. The vapor pathway 130 terminates in a shaped outlet 113', the cap cover 850 is formed and configured to movable mate with the tip. The cap cover is substantially hollow and forms a vapor fluid guide VFG which terminates into at least one fluid pathway 835. A plunger 875 with a plunger tip 880 extend inside the cover cap towards the shaped inlet. The cap cover and tip cooperate to form a substantially sealed system wherein the plunger tip 880 is configured to temporarily seal or limit most of, the vapor pathway 130 when the cover cap is pushed down along the line of arrow 1200 thereby blocking vapor flow through the outlet to VFG interface 900.

Figure 9:
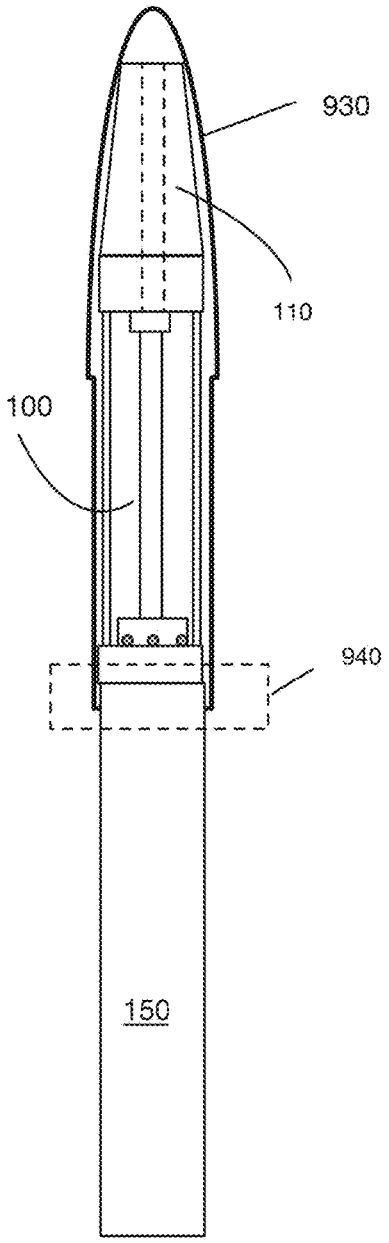
FIG. 9 illustrates a sheath utilizing a snap-on resistant vaporizer lock.

FIG. 9 shows aspects of a sheathed vaporizer pen with a body or base 150 containing a power supply and control circuitry connected to a cartridge 100 having a tip 110 covered by a vapor blocking sheath 930 which mates with the body at an interface 940. The interface represents the latch and catch systems taught in FIGS. 2A-2D.

Figure 10:
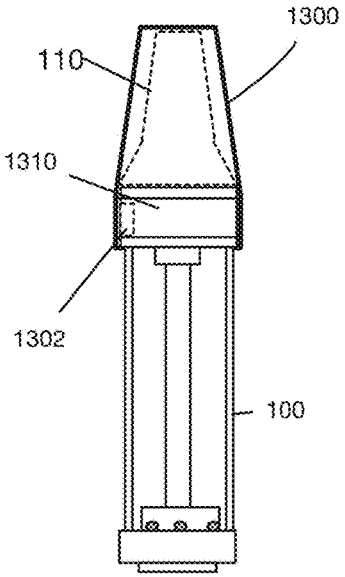
FIG. 10 illustrates a magnetic latch cap for a resistant vaporizer lock.
Figure 11:
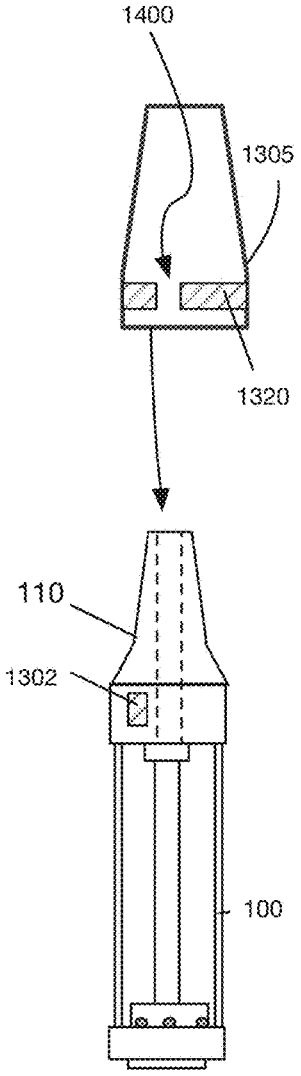
FIG. 11 illustrates a magnetic latch cap for a resistant vaporizer lock.
Figure 12A:
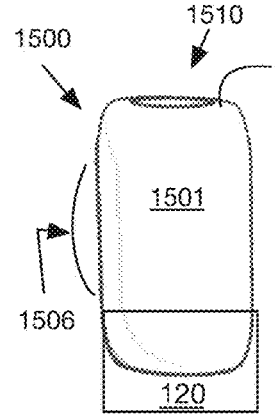
FIGS. 12A-12F illustrate a sequence of opening a squeeze valve tip.
Figure 12B:
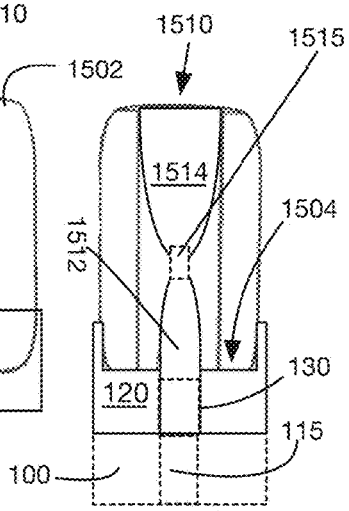
Figure 12D:
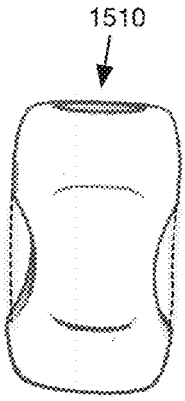
Figure 12E:
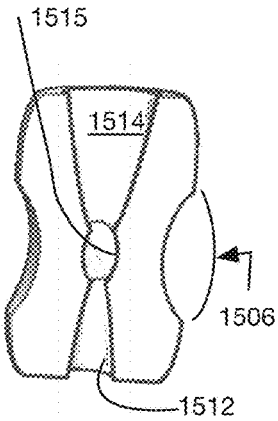
Figure 12C:
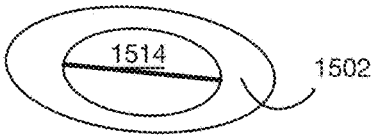
Figure 12F:
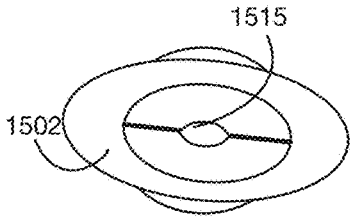

FIGS. 10 and 11 shows aspects of magnetic latch systems for a tamper resistant vaporizer cartridge and tip. In FIG. 10 a permanent magnet 1302 is affixed, embedded and/or attached to a tip 110. A cover 1300 that has at least a metallic section 1310 (however those of ordinary skill in the art will recognize the entire cover may be magnetic). When the magnet and metallic section are aligned the magnet embedded in the tip restricts removal of the cap unless sufficient force is applied. The magnet has a sufficient magnetic field to restrict removal by a predetermined age child in accordance with applicable codes and regulations as previously noted.

In FIG. 11 a permanent magnet 1302 is affixed and/or embedded or attached to a tip 110. A cover 1305 has a metallic section 1320 with a gap 1400 formed therein. The gap forms a passageway by which the cap may be removed. However, when the magnet and metallic section are aligned the magnet embedded in the tip restricts removal of the cap unless sufficient force is applied to rotate the cap around the tip and align the gap to magnet. The magnet has a sufficient magnetic field to restrict the movement by a predetermined age child in accordance with applicable codes and regulations as previously noted.

FIGS. 12A-12F illustrate a device and method of method of selective blocking and unblocking vapor flow through a tip. The squeeze tip disclosed herein as a portion of the tip which is deformable to temporarily open a fluid pathway through said tip. The pressure required to open said pathway is predetermined to exceed that of what at least 90% of five-year children can apply. Most preferable to exceed a pressure that at least 95% of five-year children can apply.

The method and device teach a linear cartridge 100 configured to with a power supply. The cartridge has a fluid vapor pathway 115. The vapor barrier also referred to as a soft tip 1500 has a vapor inlet/pathway 130 through its distal end 120 which fluidly connects with the vapor pathway 115 from the cartridge 100. The tip has a body 1501 with a top end 1502, bottom end 1504 and flexible side walls 1506 surrounding a fluid pathway formed within a pliable silicone or soft rubber-like material forming at least a portion of the tip. Within the soft tip section is formed a first half pathway 1512 fluidly connected to a second half pathway 1514 via a deformable valve 1515. The second half pathway is fluidly connected to an inhalation outlet 1510. The deformable valve 1515 is configured to open and close in response to pressure which deforms the soft tip and opens the valve. The soft tip is formed in a closed or blocking first at rest position which may be referred to as a sealed state. Operation of the valve is accomplished by exerting sufficient pressure on the sides of the soft tip via squeezing the side walls. A predetermined squeeze force deforms open the valve 1515 to a second position thereby allowing vapor produced by a cartridge fluidly connected to the tip will flow through the first and second half pathways.

To provide child protection the predetermined force is a force that is at least too great for at least ninety percent of five-year-old to overcome. More preferably the predetermined force is a force that is too great for at least ninety-five percent of five-year-old to overcome.

Figure 13:
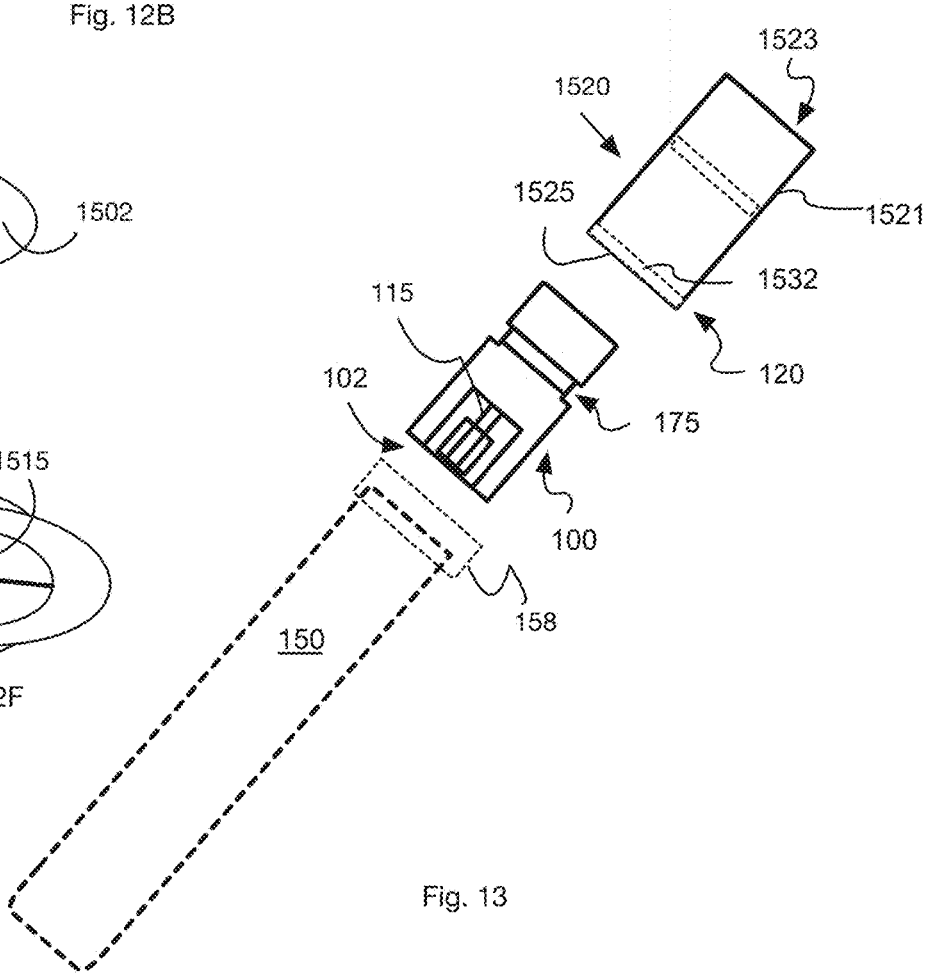
FIG. 13 illustrates an assembly view of a vaporizer cartridge or device with deformable child safe child safety vapor barrier.
Figure 14A:
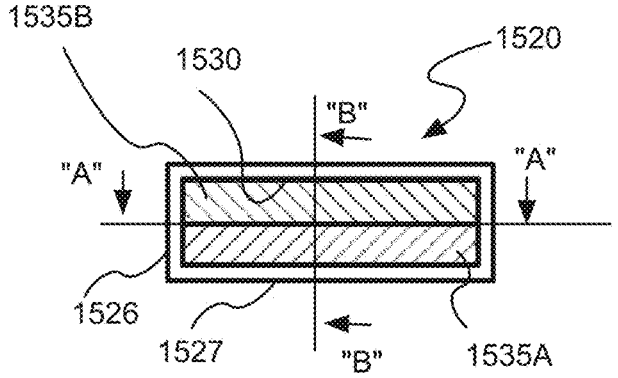
FIGS. 14A-14E illustrate a vaporizer cartridge or device with a deformable child safety child safety vapor barrier in a first position.
Figure 14B:
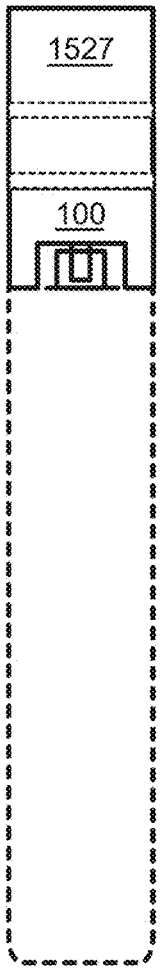
Figure 14C:
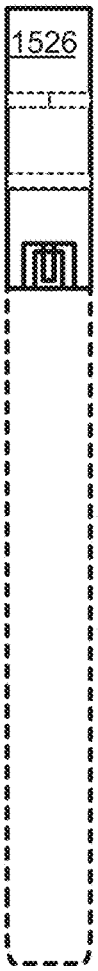
Figure 14D:
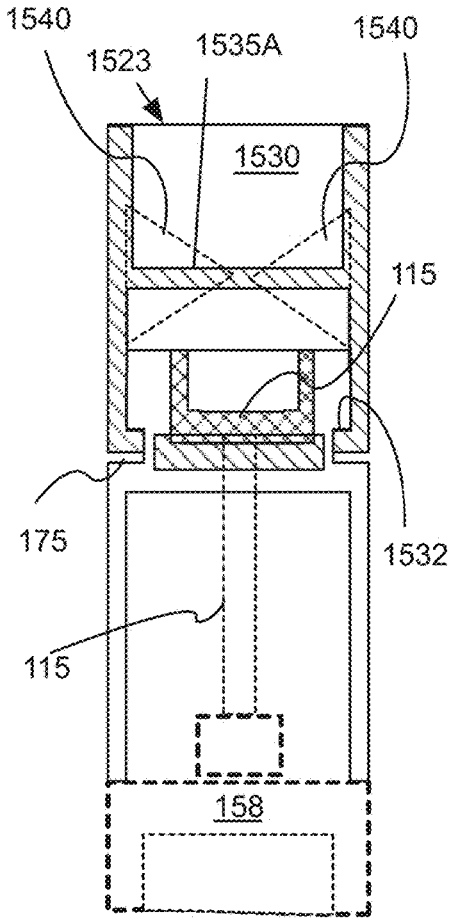
Figure 14E:
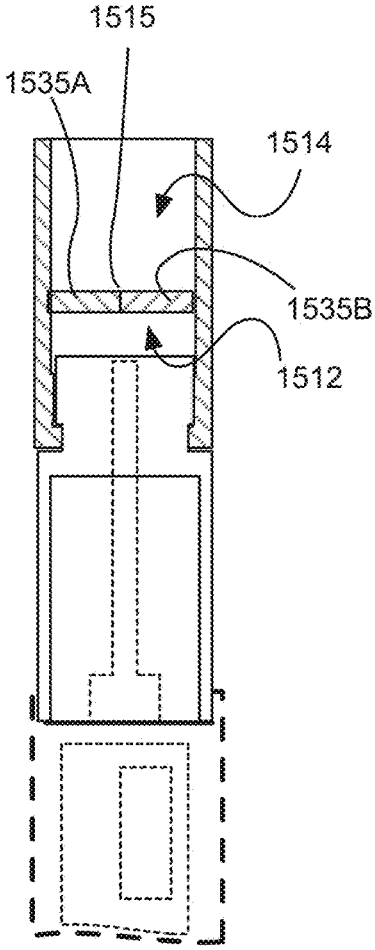

FIGS. 13-16B illustrate a device and method of method of selective blocking and unblocking vapor flow through a tip. FIG. 13 is an assembly view of a body with power supply and controller mating to a cartridge and a deformable vapor barrier. FIG. 14A is a top view of the deformable vapor barrier. FIG. 14B is a front view of FIG. 13 assembled. FIG. 14C is a side view of FIG. 13 assembled. Figured 14D is a cut-away view along the line "A"-"A" of FIG. 13. FIG. 14E is a cut-away view along the line "B"-"B" of FIG. 13. The squeeze vapor barrier disclosed herein as an extension or portion of the tip is deformable from a first at rest position to a second temporarily open position wherein a fluid pathway through the tip is opened. The deformability is the resistance to change or indentation sometimes measured in durometers. The pressure required to open said pathway is predetermined to exceed that of what at least 90% of five-year children can apply. Most preferable to exceed a pressure that at least 95% of five-year children can apply.

The method and device teach a cartridge 100 configured to mate with or affix to a body with a power supply and controller. The cartridge has a fluid vapor pathway 115. The child safety vapor barrier 1520 (also referred to as a soft tip) has a vapor inlet/pathway through its distal end 120 which fluidly connects with the vapor pathway(s) 115 from a cartridge 100. Within the child safety vapor barrier is formed a first half pathway 1512 fluidly connected to a second half pathway 1514 via a deformable valve 1515. The second half pathway is fluidly connected to an inhalation the open top 1523 forming an inhalation outlet. The deformable valve 1515 is configured to open and close in response to pressure which deforms the vapor barrier and opens the valve. The deformable vapor barrier 1520 is at rest in a first position which is closed or blocking vapor fluid flow. The at rest which may be referred to as a sealed state. Operation of the valve is accomplished by exerting sufficient pressure on the child safety vapor barrier to open the valve. The vapor barrier has a body 1521 surrounding an open top end 1523, an open bottom end 1525 and flexible or deformable side walls 1526 and front and back walls 1527, which form an annular inner wall 1530 surrounding the first half pathway 1512 and the second half pathway 1514 separated by the valve 1515 which is a pliable silicone or soft rubber-like material forming at least a portion of the deformable vapor barrier. The skilled artisan and those of ordinary skill in the art will recognize that the vapor barrier is a pliable device described above and the pliable device may be a portion of, or connected to a cartridge. Near the open bottom 1525 of the deformable vapor barrier a first interface 1532 is formed and configured to mate with a second interface 175 on the cartridge (which may include a cap 1800 (see FIG. 25A) attached to the cartridge) or device. The attachment may be permanent or temporary but in all instances the first and second interface are configured to attach whereby a force greater than that which can be applied by at least 90% of five-year children. Most preferable to exceed a force that at least 95% of five-year children can apply. The interfaces may be pressure fit, friction fit, sonic welded, glued, co-molded or otherwise fixed. Those of ordinary sill in the art will recognize that the deformable vapor barrier may also be formed as a part of a tip on a cartridge and without the interface and such an embodiment is within the scope of this disclosure.

Within deformable vapor barrier is formed a first half pathway 1512 fluidly connected to a second half pathway 1514 via a deformable valve 1515 separating the half pathways. The second half pathway is fluidly connected to an inhalation outlet through the open top 1523. The deformable valve 1515 is configured to open and close in response to pressure which deforms the soft tip and opens the valve. The deformable vapor barrier is normally (when no pressure is applied) in a first at rest and closed/blocking state which may be referred to as a sealed state. Operation of the valve is accomplished by exerting sufficient pressure on the side wall(s) of the deformable vapor barrier via squeezing. A predetermined squeeze force deforms the deformable vapor barrier into the second state with the valve 1515 temporarily open thereby allowing vapor produced by a cartridge fluidly connected to the deformable vapor barrier to flow through the first and second half pathways. To provide child protection the predetermined force is a force that is at least too great for at least ninety percent of five-year-old to overcome. More preferably the predetermined force is a force that is too great for at least ninety-five percent of five-year-old to overcome. In some instances the valve may have two half sections 1535A and 1535B extending from the inner annular wall 1530.

Figure 15A:
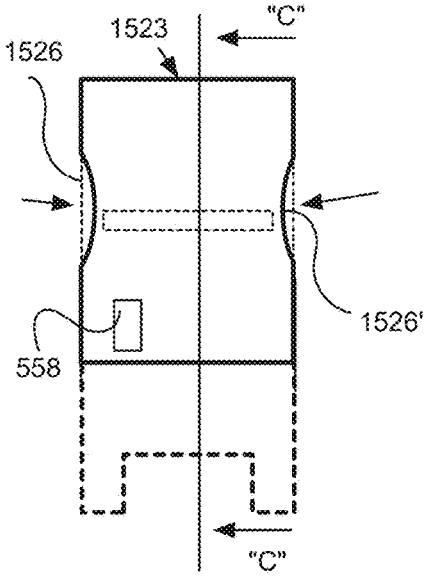
FIGS. 15A-15C illustrate aspects of a vaporizer cartridge or device with a deformable child safety child safety vapor barrier in a second position.
Figure 15B:
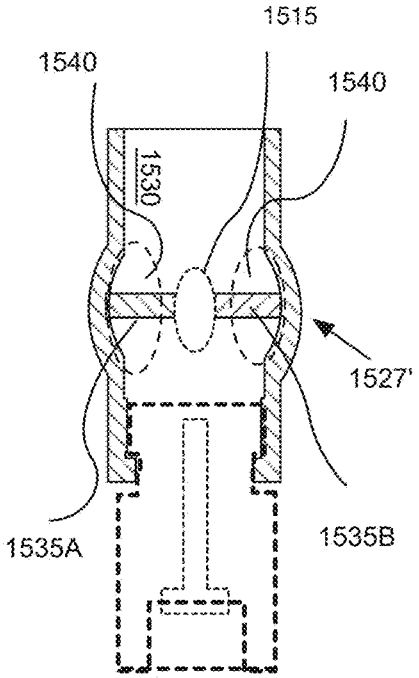
Figure 16A:
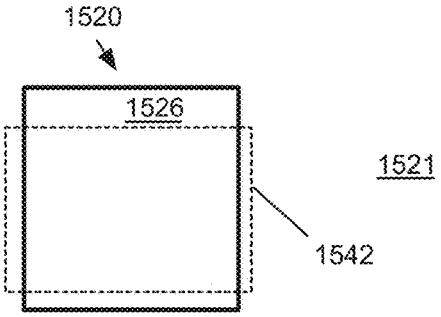
FIGS. 16A-16B illustrate force limiting regions which may optionally be combined with a deformable child safety vapor barrier.
Figure 15C:
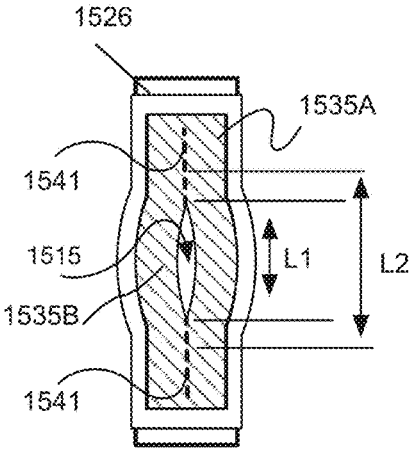
Figure 16B:
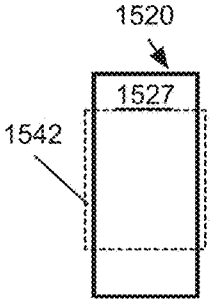
Figure 15D:
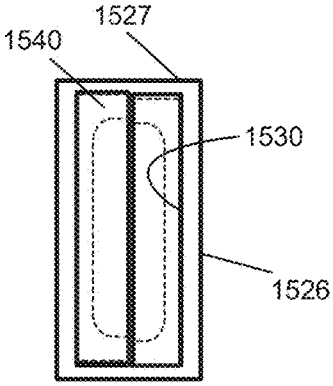
FIG. 15D illustrates a deformable child safety vapor barrier in a first position with optional stiffening regions.
Figure 17A:
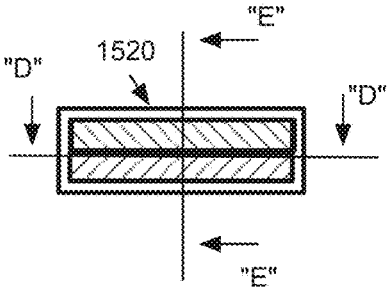
FIGS. 17A-17C illustrate a deformable child safety child safety vapor barrier for a vaporizer cartridge or device with internal torque limiting structure in a first position.

FIG. 15A illustrates a front view of the deformable vapor barrier of FIG. 13 with the flexible side walls 1526 squeezed thereby displacing the flexible side walls 1526'. FIG. 15B is a cutaway view along line "C"-"C" of FIG. 15A. Showing the displaced front and back walls 1527' caused by moving the deformable vapor barrier from the first position to the second position and opening the valve 1515 by separating the two half sections. Stiffening regions 1540 are areas which may be adjusted in thickness to increase the pressure needed to open the valve. FIG. 15C shows the valve 1515 open from a top view. Valve forming regions 1541 are configurable during manufacturing to select a desired valve length. The adjustment of the valve opening can be used to adjust the force needed to open the valve 1515. If the valve opening is at "L1" there is less front and back wall to displace adjacent to the valve opening and greater force is needed to open the valve. If the opening is set a "L2" the force required to open is less than a length of opening of "L1" because there is more front and back wall to displace. FIG. 15D illustrates optional stiffening regions. By changing the thickness of stiffening regions 1540 additional adjustments can be made to preselect the desired force needed to open the valve into the second position. FIGS. 16A-16B illustrate exterior regions 1542 for stiffening of the child safety vapor barrier FIG. 17A illustrate a top view of a deformable child safety vapor barrier for a vaporizer cartridge or device with an internal scaffold.

Figure 17B:
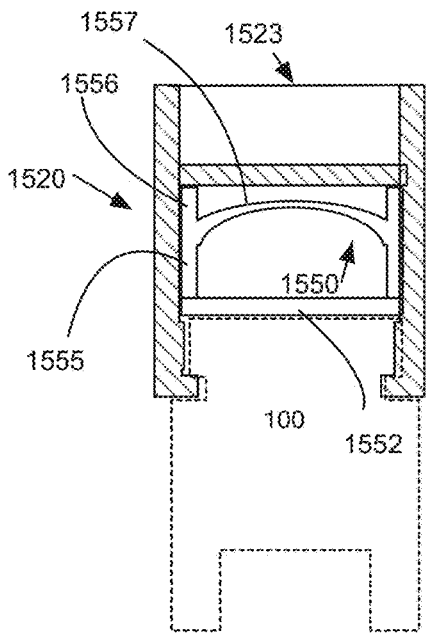
Figure 17C:
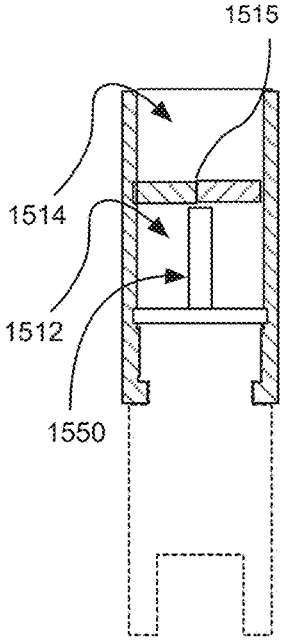
Figure 18A:
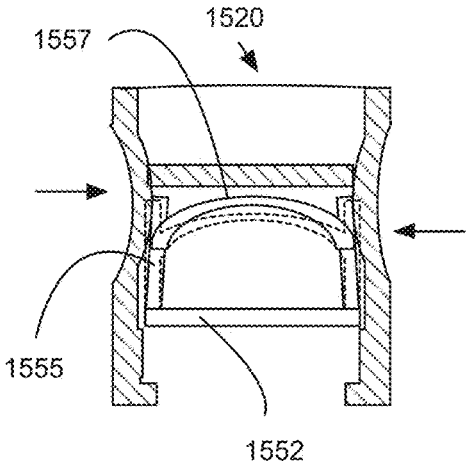
FIGS. 18A-18C illustrate a deformable child safety child safety vapor barrier for a vaporizer cartridge or device with internal torque limiting structure in a second position.
Figure 18B:
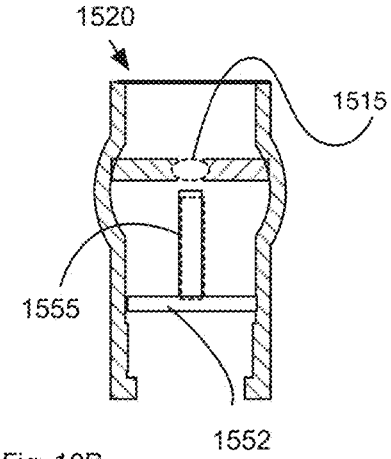
Figure 18C:
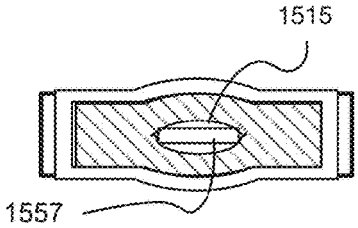

FIG. 17B illustrate a deformable child safety vapor barrier for a vaporizer cartridge or device with internal torque limiting structure (also referred to as an internal flexible scaffold 1550) in a first position cut-away along the lines of arrow "D"-"D". FIG. 17C illustrate a deformable child safety vapor barrier for a vaporizer cartridge or device with internal flexible scaffold 1550 in a first position, cut-away along the lines of arrow "E"-"E". Inside the first half pathway 1512 is illustrated as an internal flexible scaffold 1550. The skilled artisan will recognize that placing said flexible scaffold 1550 in the second half pathway 1514 is within the scope of the disclosure. The flexible scaffold is a base 1552 which fits snuggly into the half pathway. Two legs 1555 extend upward from the base connected at one end and with a free (unconnected) end 1556. A bridge 1557 is connected to each leg below the free end 1556. The bridge is shaped to direct it to bend when sufficient force is applied to the legs and open the valve. FIGS. 18A-18C illustrate the internal flexible scaffold 1550 in a second position when force has been applied to the side walls of the deformable child safety vapor barrier. In the second position the valve 1515 is open to provide a fluid pathway for vapor. The force required to open said pathway is predetermined to and one of exceed a force that at least 85% of five-year children can apply, at least 90% of five-year children can apply and at least 95% of five-year children can apply.

Figure 19A:
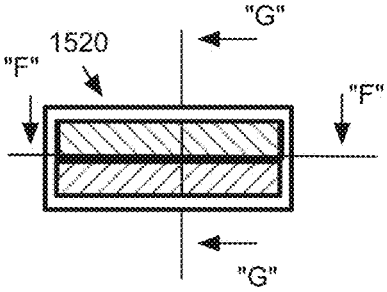
FIGS. 19A-19C illustrate a deformable child safety child safety vapor barrier for a vaporizer cartridge or device with an external force limiting fixture in a first position.
Figure 19B:
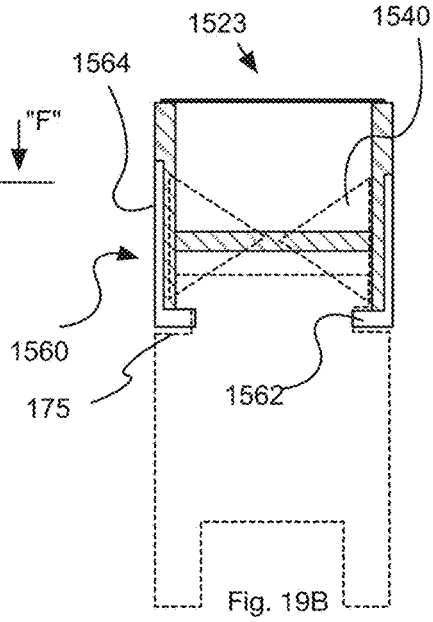
Figure 19C:
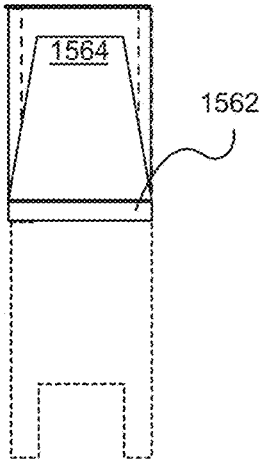

FIGS. 19A-19C illustrate a deformable child safety cap for a vaporizer cartridge or device with external torque limiting structure in a first position.

FIG. 19A illustrate a top view of the deformable child safety vapor barrier for a vaporizer cartridge or device having an external force limiting fixture.

FIG. 19B illustrate aspects of the deformable child safety vapor barrier for a vaporizer cartridge or device with external force limiting fixture 1560 in a first position cut-away along the lines of arrow "F"-"F". FIG. 19C illustrate a deformable child safety vapor barrier for a vaporizer cartridge or device with external force limiting fixture 1560 in a first position, cut-away along the lines of arrow "G"-"G".

The external force limiting fixture 1560 has an interface end 1562 configured to mate with a second interface 175 on the cartridge or device. The external force limiting fixture has a second free end 1564 configured to move when sufficient force is applied.

Figure 20A:
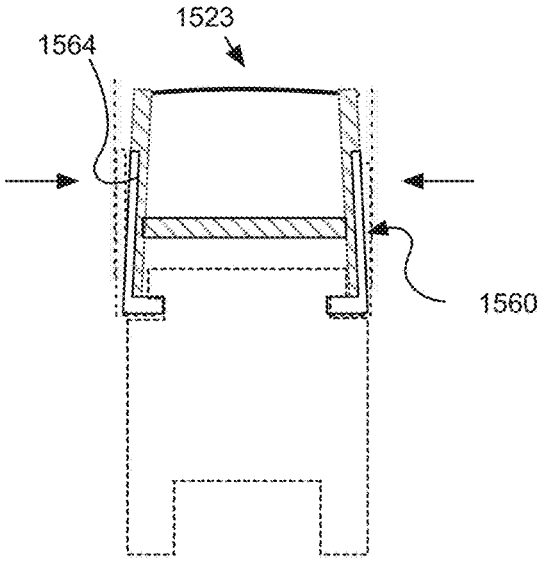
FIGS. 20A-20C illustrate a deformable child safety child safety vapor barrier for a vaporizer cartridge or device with an external force limiting fixture in a second position.
Figure 20B:
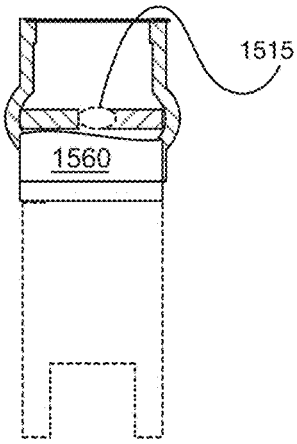
Figure 20C:
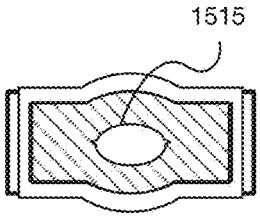
Figure 21A:
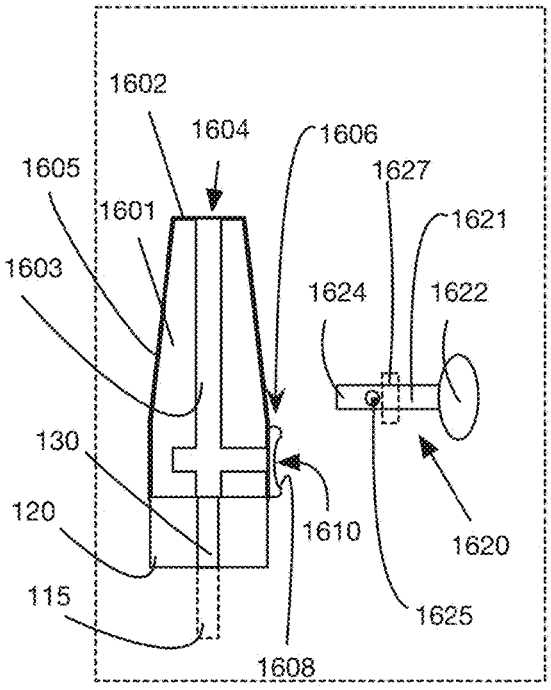
FIGS. 21A-21E illustrate a turn valve tamper proof tip and a sequence of opening a fluid pathway in a tip.
Figure 21B:
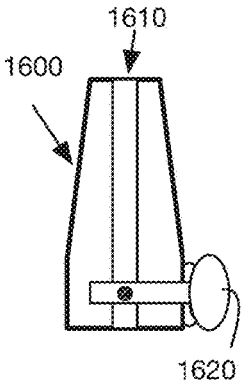
Figure 21C:
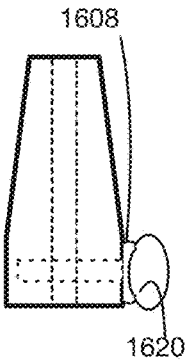
Figure 21D:
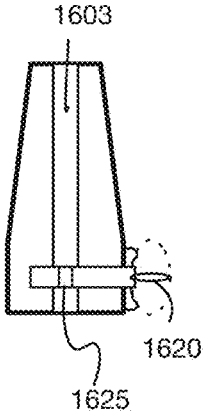
Figure 21E:
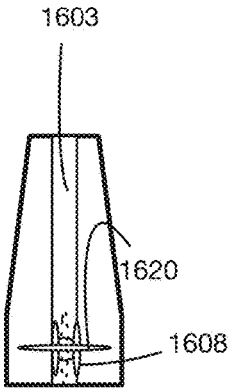

FIGS. 20A-20C illustrate the external force limiting fixture 1560 in a second position wherein force has been applied to it and the side walls of the deformable child safety vapor barrier. In the second position the valve 1515 is open to provide a fluid pathway for vapor. The force required to open said pathway is predetermined to and one of exceed a force that at least 85% of five-year children can apply, at least 90% of five-year children can apply and at least 95% of five-year children can apply.

FIGS. 21A-21E illustrate a turn valve tamper proof tip and a sequence of opening a fluid pathway in the tip. The device and method includes a method of selective blocking and unblocking vapor flow through a tip. The stem valve disclosed herein is a rotatable fixture configured to twist under a predetermined torque whereby one or more rotation limiting fixtures on the side edge of the cartridge 1605 prevent opening the fluid pathway through the tip unless adequate torque is supplied. A linear vaporizer cartridge 100 configured to mate with a power supply having a first end 102 with a vapor pathway 115 fluidly connected to a tip connection 118. The tip 1600 has a vapor inlet/pathway 130 through its distal end 120 which fluidly connects with the vapor pathway 115.

The tip 1600 has a body 1601 and a series of fluid connections therein. At a proximal end 1602 an outlet 1604 is configured which is fluidly connected to a valved pathway 1603. On a portion of the outer annular wall 1605 of the tip at least one fixture forming a force limiting rib (FLR) 1606 is formed. Each FLR is a shaped plastic with adequate memory to flex and return to there at rest position thereafter. The flexible protruding rib(s) has shaped extended arms 1608 configured to require a predetermined amount of force to bend. The FLRs are positioned adjacent to a valve stem guide 1610. The valve stem 1620 is configured to mate with the stem guide in a rotatable fashion. The interface of the valve stem to the stem guide should be snug whereby the valve stem can rotate but will also block the valved pathway 1603 when in the closed position. At the distal end 120 of the tip a vapor pathway 130 is connected to the outlet 1604. The valve stem 1620 has an elongated body 1621, a stem proximal head 1622, a distal stem end 1624, and a valve connect 1625 configured to mate within the stem guide and block the fluid pathway in a first configuration and unblock the fluid pathway in a second configuration. In the first configuration the valve connect is closed and perpendicular to the valved pathway 1003. In the second or open configuration the valve connect is aligned with the valved connect thereby allowing vapor flow.

In operation a user grasps the stem proximal head 1622 which, in the first configuration is closed, and exerts sufficient torque on the valve stem to rotate the proximal head past the FLR extended arms 1608 (which are flexible and will, under sufficient force, bend to allow passage of the proximal head). The twisting aligns the valve connect to the second thereby allowing vapor to flow through the valved pathway. Closing the valved pathway is achieved by reversing the above process/method of operation wherein the stem proximal head can be turned past the FLR be a predetermined amount of rotational force or torque.

The predetermined force to overcome the arm of the FLR is at least a force that is too great for at least ninety percent of five-year-old to overcome. More preferably the predetermined force is a force that is too great for at least ninety-five percent of five-year-old to overcome.

Figure 22A:
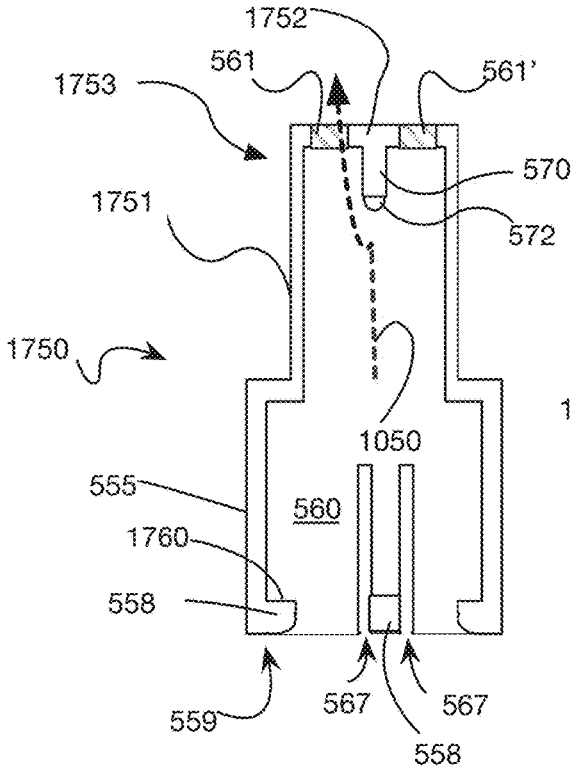
Figure 22B:
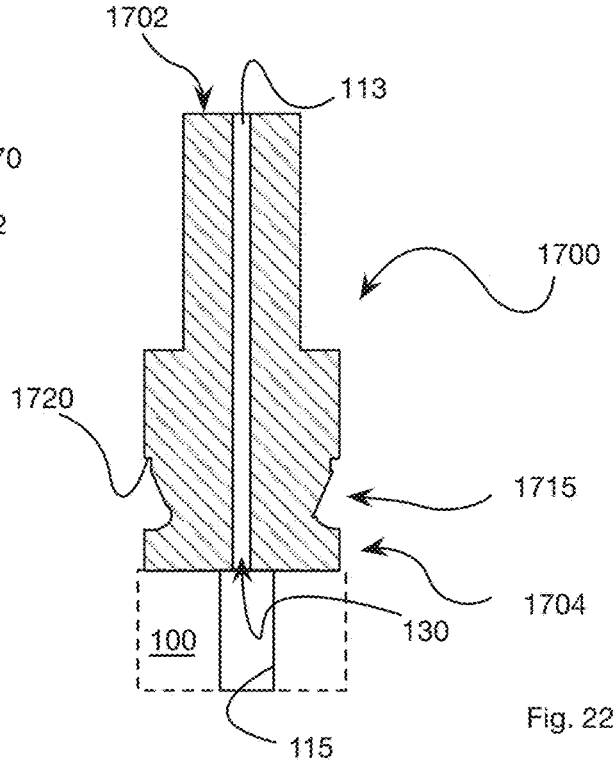

FIGS. 22A-D22 and 23A-23B show aspects of illustrate axially extending latches on a child safe barrier which are configured to engage with catches on a tip to limit upward movement of the barrier and/or unintended usage of a vaporizer. The active catches are sloped to drive the barrier back towards a blocking position in the absence of necessary force to lift the barrier and unblock. The force necessary is fixed at a predetermined amount. In some instance the force required to move the barrier upward to open the pathway for vapor is a force that exceeds the force that at least 80% of 5-year-old children can exert. More preferable exceeds the force that at least 90% of 5-year-old children can exert and most preferably exceeds the force that at least 95% of 5-year-old children can exert. When the force holding the barrier above the tip is released the sloped catches cooperate with the flexible legs to move the barrier downward over the tip and block the vapor pathway. The tip and barrier are configured so that at rest the vapor pathway s blocked.

FIGS. 22A-22D and 23A-23B illustrate extending latches on a barrier which are configured to engage catches on a tip to limit movement of the barrier and/or unintended usage of a vaporizer. A tip 1700 is configured to movably mate with a barrier cap 1750. The tip 1700 is configured with at least one vapor outlet 130 formed therethrough. It has a proximal end 1702 with an outlet 113 and a distal end 1704. The distal end 1704 is configured to mate with the tip connection a cartridge 100 forming a fluid pathway from the cartridge's vapor pathway 115 to the tip's outlet vapor 130. The barrier 1750 is a generally hollow body 1751 and a top 1752 formed as part of the barrier. The top 1752 partially covers the proximal end 1753 of the body and is configured to partially sealing the top 1752 at distal end 1754 is opposite the top. The hollow body 1751 forms a vapor flow guide (VFG) 560 wherein vapor from an unblocked outlet 113 will flow. The VFG terminates into at least one inhalation port 561 and 561' which form inhalation outlet(s) whereby vapor can flow along the line 1050. Inside the barrier cap is at least one plunger 570. The plunger is an extended leg which is configured to block the outlet 113 when moved into same. At the end of the plunger is a shaped plunger tip 572 that is configured to reversibly block said outlet 113.

The barrier 1750 is configured to cooperate with the tip 1700 to facilitate limited movement of the barrier axially along the tip. Said movement requires a force that exceeds the force at least 80% of 5-year-old children can exert. More preferable exceeds the force 90% of 5-year-old children can exert and most preferably exceeds the force at least 95% of 5-year-old children can exert.

Cap Movement

From the distal end of the barrier extend at least one moving latch wall 555 is separated by a vertical flex guide 567. Each moving latch wall 556 and finger latch 558 is configured to face the center of said barrier. The depiction of the flexible finger as a small area of the distal end of the cap is not a limitation and those of ordinary skill in the art will understand that the range of flexible fingers or wall sections may be a larger or smaller. The choice of material may impact the finger dimensions to achieve a predetermined latching force. Flexible finger and latch are configured to reversible latch into catches formed on the tip. A section of the wall forms a moving latch wall 555, supporting a finger latch 558, which is configured to bend without breaking if sufficient force is applied to the flexible finger latch. That moving latch wall 555 is configured to act as a living hinge, it may be thinner or thicker than other portions of the cap, it may have ribs, grooves, or other surface features to create a predetermined flexure to require a predetermined force to displace. In some instances the moving latch wall and regions distance from the free end 559 of the moving latch wall 555 cooperate to limit finger latch 558 movement to correspond to a predetermined amount of force being applied. The sloped catch 1715 is an annular catch shaped to have a smaller cross-sectional diameter near the distal end 1704 and a larger cross-sectional diameter near the proximal end 1702 of the tip. One or more optional stops 1720 may be formed to limit removal of the barrier, such optional stops may be formed in the tip to limit upward movement of the barrier via blocking the flat top 1760 of the finger latch 558. Said stop should not limit downward movement.

In operation the finger latch 558 and flexible finger 555 are shaped whereby at rest they are straight and not curved or splayed outward. The sloped catch 1715 is configured to require the flexible fingers 555 to distort and splay outward to overcome the increasing cross-sectional diameter as the barrier is moved upward away from the distal end of the tip along the line of arrow 1790. The displacement requires a predetermined force to be overcome. When the barrier is moved upward by applying sufficient force the plunger 570 and plunger tip 572 inside the barrier cooperatively move along the same line as the barrier relative to the tip the lifted plunger no longer blocks the outlet 113.

Accordingly, vapor can flow through the vapor flow guide (VFG) and exit the barrier via the at least one inhalation ports 561/561'. When the force lifting the barrier is reduced to below the threshold to raise the barrier, the sloped catch urges the cap downward towards the distal end of the tip.

Figure 22C:
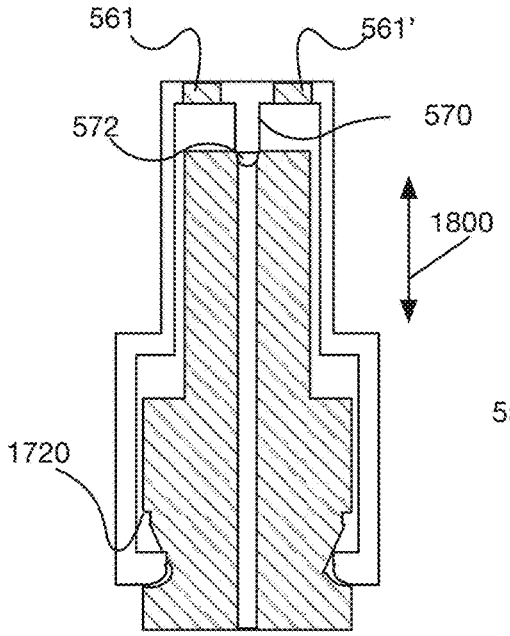
Figure 22D:
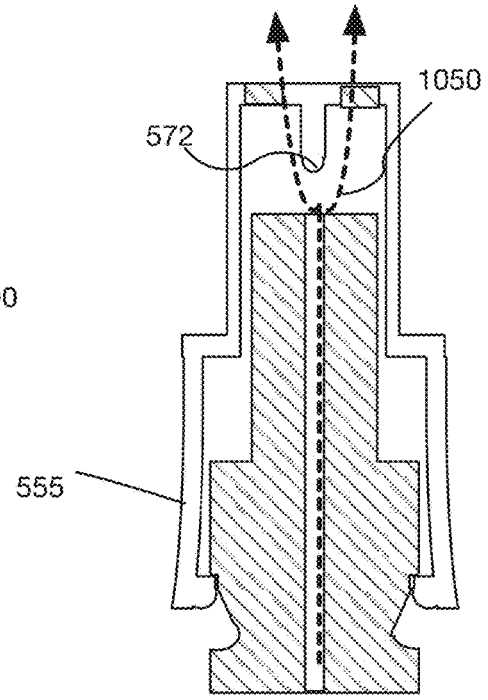

Prior movable tips required one or more catches to cooperate to place the barrier into an open position allowing vapor flow and hold the barrier in a blocked position. The instant disclosure urges the barrier into a closed position if the barrier is released. FIG. 22C shows the closed or blocked at rest first position and FIG. 22D shows the open fluid flow second position when the flexible fingers are displaced.

In some instances the vapor barrier cap may be disposable as is the cartridge—the action of the flexible finger cooperating with the sloped catch and should provide for at least the number of use cycles said cartridge can supply. A use cycle is generally the number of consumer uses of the device. Generally speaking at least 60 movements between catch one and catch two (a cycle) for a 1 ml cartridge would be expected. More preferable at least 70 cycles, most preferable at least 90 cycles.

Figure 23A:
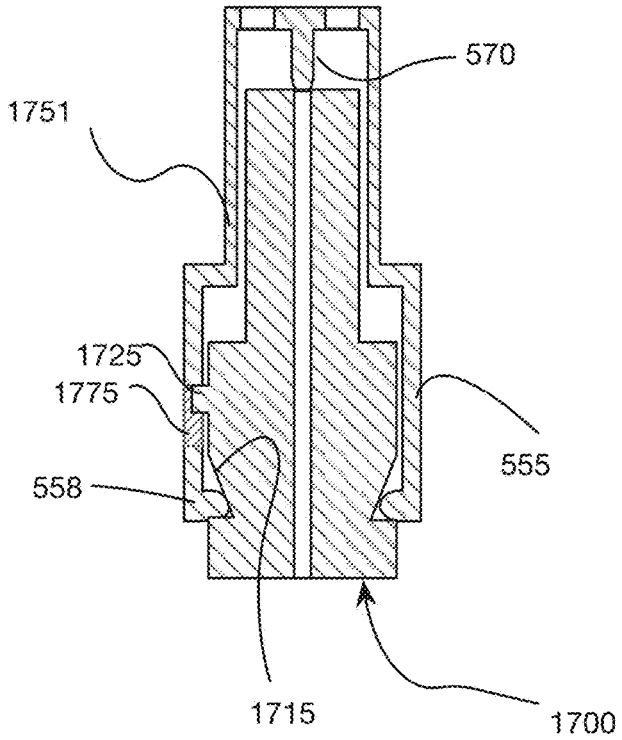
FIGS. 23A-23B illustrate extending latches on a cap which are configured to engage catches on a tip to limit movement of the barrier and/or unintended usage of a vaporizer.
Figure 23B:
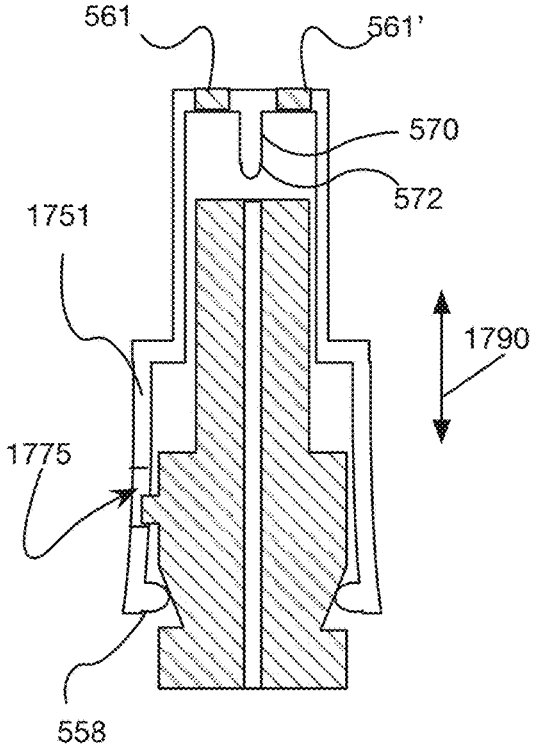
Figure 24:
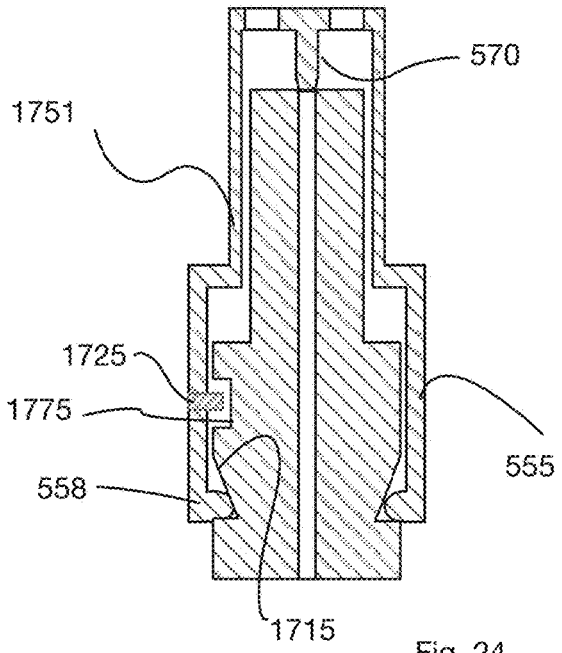
FIG. 24 illustrates an interface formed on the tip and a stop extends inward from the barrier.

FIGS. 23A and 23B illustrate aspects of another sloped catch 1715 on a tip 1700. An interface 1775 is formed through the barrier body the interface is configured to receive a stop 1725 extending from the tip body. FIG. 24 illustrates and exemplar wherein the interface 1775 is formed on the tip and the stop 1725 extends inward from the barrier.

The child safety the vapor barrier may be permanently affixed to the tip. In other instance the vapor barrier mounting to the cartridge, or tip is configured such that the force required to separate the vapor barrier from the device exceeds the force at least 80% of 5-year-old children can exert. More preferable exceeds the force 90% of 5-year-old children can exert and most preferably exceeds the force at least 95% of 5-year-old children can exert.

Figure 25A:
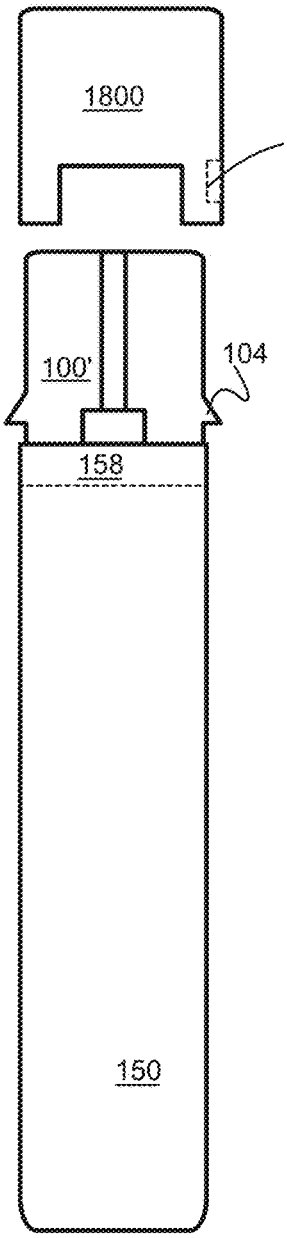
FIGS. 25A-25C illustrate a vaporizer cartridge or device without safety tip.
Figure 25B:
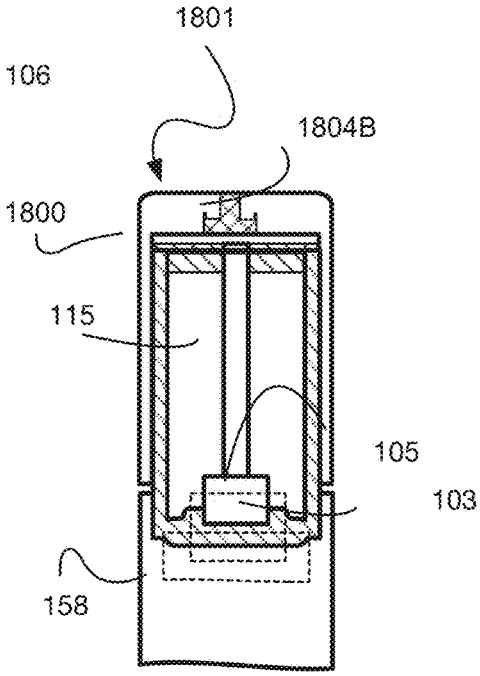
Figure 25C:
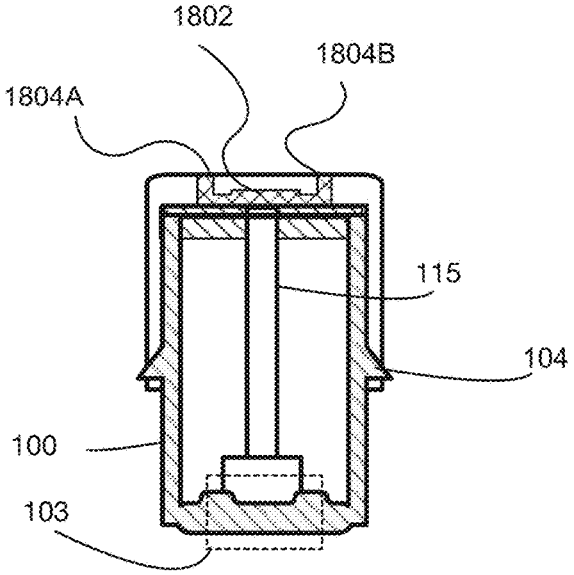

FIGS. 25A-25C illustrate a vaporizer cartridge or device without safety tip. In some instance a cartridge 100' is configured with latches 104 extending outward from the cartridge to capture a cover 1800 and hold it onto the cartridge 100 via at least one catch 106 through the cap 1800. FIGS. 25B and 25C show orthogonal cut-away view of the cartridge including outlets which are configured to fluidly connect to vapor pathway 115 via the cap outlet interface 1802. Half-outlets 1804A and 1804B are formed through the top 1801 of the cap and are fluidly connected to the cap outlet interface 1802.

Figure 26A:
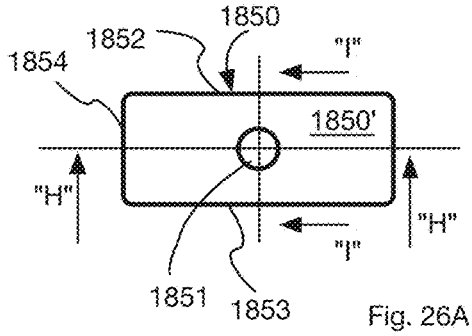
FIGS. 26A-26D illustrate a vaporizer cartridge or device with a child safety cap in a first position.

FIGS. 26A-26D illustrate a vaporizer cartridge or device with a child safety cap in a first position. FIG. 26A is a to view of a child safety vapor barrier 1850 over a cartridge 101'. The vapor barrier has a top 1850', barrier outlet 1851, front side 1852, a back side 1853 and two opposing sides 1854.

Figure 26D:
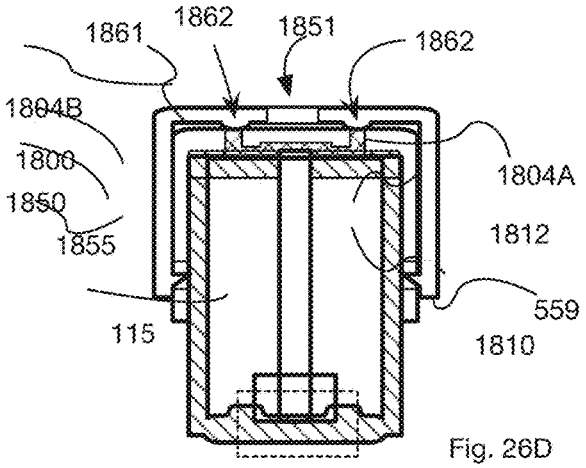
Figure 26B:
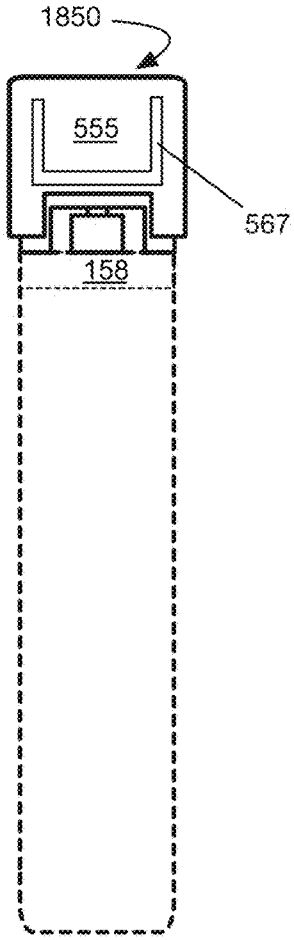

FIG. 26B is a front view FIG. 26A showing the force limiting leg 555.

Figure 26C:
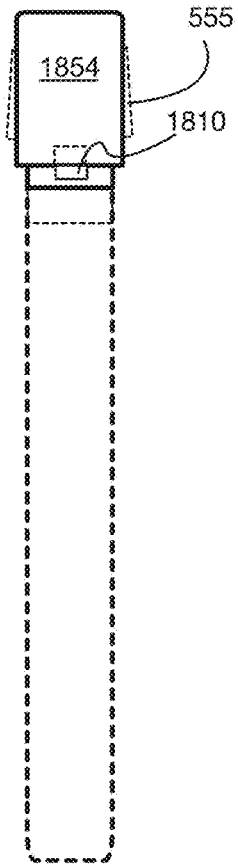

FIG. 26C is side view of FIG. 26A the movement range of the force limiting leg 555 from a second extended position to the first at rest position is shown. A catch is formed in the cartridge or cartridge 101' or cap 1800. FIG. 26D shows a cutaway view along the line "H"-"H" showing the latch 1855 showing within the catch 1810. The catch has an upper limit 1812. When the vapor barrier 1850 is at rest the restrictive regions 1862 of the inner wall 1861 of the vapor barrier block the fluid flow from each of the half-outlets 1804A and 1804B to the barrier outlet 1851.

Figure 27A:
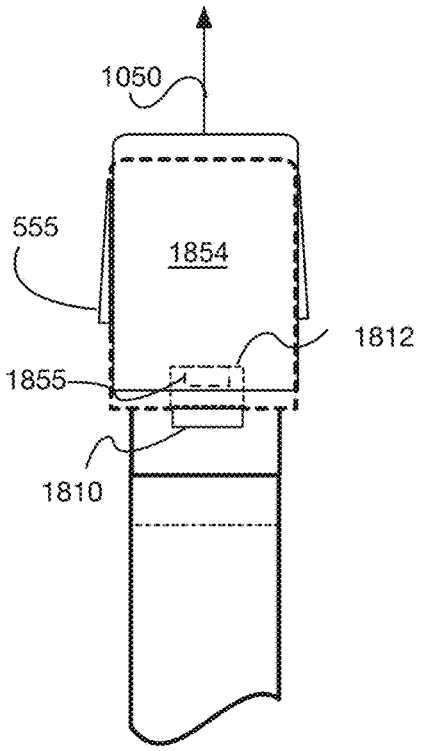
FIGS. 27A-27C illustrate a vaporizer cartridge or device with a child safety cap in a second position.
Figure 27B:
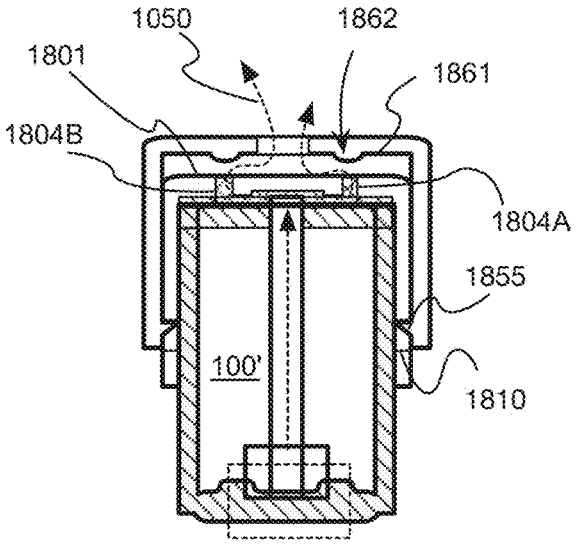
Figure 27C:
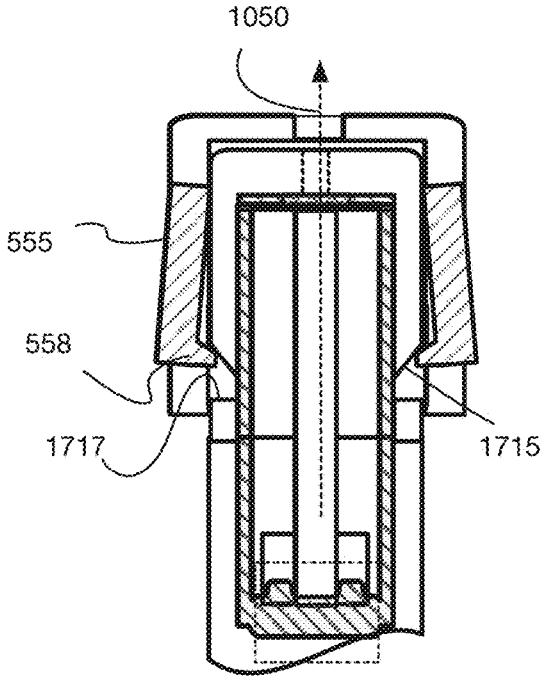

FIG. 27A-27C shows the vapor barrier in a second position which requires force to maintain but is also configured to allow fluid connection from half-outlet 1804A/B and the barrier outlet 1851 for inhalation. FIG. 27A is a side view of the safety vapor barrier 1850 in the second position wherein the latch 1855 is at the upper limit 1812 of the catch. FIGS. 27A and 27B illustrate displacing the top 1850' of the vapor barrier 1850 relative to the top 1801 of the cap fluidly connects the half-outlets by moving the restrictive regions 1862 of the inner wall apart from the half-outlets allowing vapor flow 1050. FIG. 27B is a cut-away view along line "H-"H" of FIG. 26A. When the vapor barrier is displaced the force limiting legs 555 are also displaced and such displacement requires continued force to be applied or the vapor barrier will move to the at rest first position. FIG. 27C is FIG. 27B is a cut-away view along line "I-"I" of FIG. 26A and it shows a moving wall latch 556 force limiting legs The barrier 1850 is configured to cooperate with the cartridge 101" and/or the cap 1800 to facilitate limited movement of the vapor barrier 1850 axially along the cartridge. Said movement requires a force that exceeds the force at least 80% of 5-year-old children can exert. More preferable exceeds the force 90% of 5-year-old children can exert and most preferably exceeds the force at least 95% of 5-year-old children can exert. Additionally, for child safety the vapor barrier may be permanently affixed to the cap. In other instance the vapor barrier mounting to the cartridge, or cap is configured such that the force required to separate the vapor barrier from the device exceeds the force at least 80% of 5-year-old children can exert. More preferable exceeds the force 90% of 5-year-old children can exert and most preferably exceeds the force at least 95% of 5-year-old children can exert.

Cap Movement

From the distal end of the barrier extend at least one moving latch wall 555 separated by a vertical flex guide 567. Each moving latch wall 555 and finger latch 558 is configured to face the center of said vapor barrier. The depiction of the flexible finger as a small area of the end of the barrier is not a limitation and those of ordinary skill in the art will understand that the size and number of flexible fingers or wall sections may be a larger or smaller. The choice of material the properties such as durometers may impact the finger dimensions to achieve a predetermined force form a selected material. The moving latch wall 555 is configured to act as a living hinge, it may be thinner or thicker than other portions of the barrier, it may have ribs, grooves, or other surface features to create a predetermined flexure to require a predetermined force to temporarily displace the vapor barrier to the open second position. The sloped catch 1715 is an annular catch shaped to have a smaller cross sectional near the bottom of the catch 1717 and a larger cross-sectional diameter near the top 1801 of the cap.

In operation the finger latch 558 and flexible wall 555 are shaped whereby at rest they are straight and not curved or splayed outward. The sloped catch 1715 is configured to require the application of an axially force to move the finger latch up the sloped catch which causes the flexible wall 555 to distort and splay outward to overcome the increasing cross-sectional diameter of the sloped catch as the vapor barrier is moved away from the distal end of the cap 1801'. The displacement requires a predetermined force to be overcome. When the barrier is moved upward by applying sufficient force the restrictive regions 1862 inner wall 1861 of the vapor barrier no longer blocks the half-outlets 1804A/B. Accordingly, vapor can flow through the vapor barrier and exit the barrier via the half-outlets 1804A/B. When the force lifting the vapor barrier is reduced to below the threshold to raise the barrier, the flexible wall will return to the first at rest position as the displace the finger latch 558 and flexible wall are urged downward towards bottom of the catch 1717.

In some instances the vapor barrier cap may be disposable as is the cartridge—the action of the flexible wall cooperating with the sloped catch and should provide for at least the number of use cycles said cartridge can supply. A use cycle is generally the number of consumer inhalation or uses of the cartridge.

Figure 28:
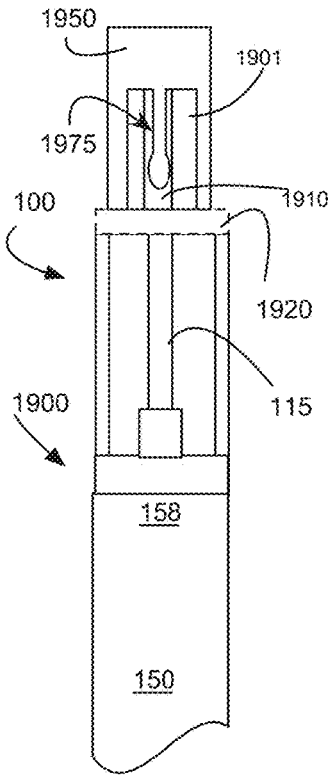
FIG. 28 illustrates a rotatable child safety vaporizer cap and tip combination

FIG. 28 illustrates a side view of a child safety vaporizer barrier and tip combination wherein the vapor barrier is rotated to a second open position from a first at rest position by applying a preselected force and the vapor barrier to unblock a fluid pathway. When the force is removed the vapor barrier will rotate back to the first at rest closed position. The tip 1901 is partially covered with the vapor barrier 1950. The combined tip and vapor barrier are fluidly connected to the cartridge by way of a safety tip connection 1920 which affixes the tip. The vapor is rotatably affixed to said tip.

Figure 29B:
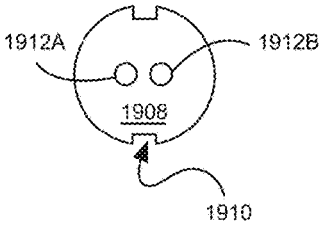
FIGS. 29A-29C illustrates the tip of FIG. 28.
Figure 29A:
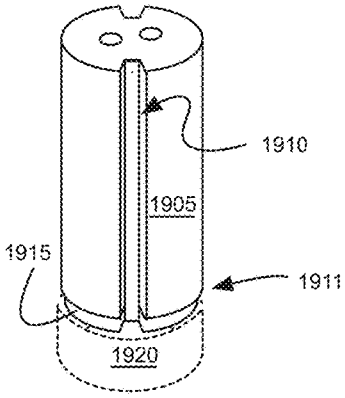
Figure 29C:
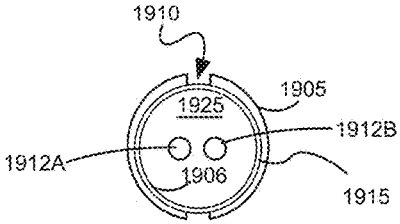

FIGS. 29A-29C illustrate the top, bottom and side of the tip 1901 shown in FIG. 28. The tip has an outer body 1905, a first side of the top 1908 with one or more vapor apertures 1912A and 1912B forming fluid passages therethrough. Along the outer body wall 1905 of the tip is formed a linear catch 1910. At the bottom region of the tip 1911 is a vapor barrier first interface 1915. The second side of the top 1925 is shown in FIG. 29C and the inner annular wall 1906 of the tip body forms the fluid pathway from the vapor pathway 115 of the cartridge 100.

Figure 30B:
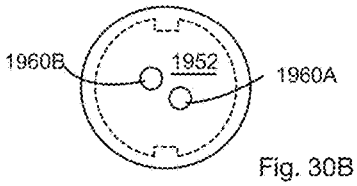
FIGS. 30A-30C illustrates the cap of FIG. 28-29C.
Figure 30A:
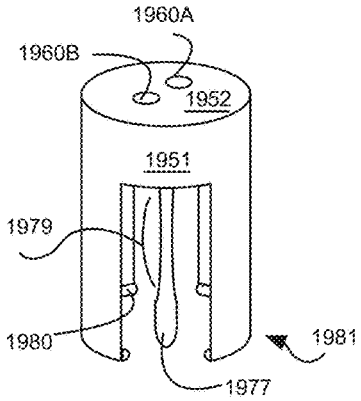
Figure 30C:
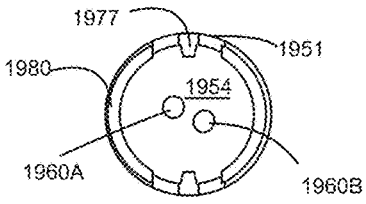

FIGS. 30A-30C illustrate illustrates the top, bottom and side of the vapor barrier 1950 shown in FIG. 28. The vapor barrier 1950 has a first side of the top 1952 with one or more barrier apertures 1960A and 1960B configured to align with the vapor apertures 1912A and 1912B of the tip. Along the barrier outer wall 1951 is formed one or more torque control legs 1975. Each leg has a free torque limiting end 1977 and is attached to the flexible shaft 1979 of the torque control leg 1975. A second half interface 1980 is formed near the bottom of the vapor barrier 1981 which is a mount to the tip configured to allow rotational movement around the tip limited by the torque control leg(s). Those of ordinary skill in the art and the skilled artisan will understand that variation in the number, size and location of torque limiting control members are within the scope of the disclosure.

In operation the vapor barrier 1950 when mounted to the tip is mounted at the first and second half interfaces (1950/1980) and the mounting allows for rotational movement. However, the mounting is also configured such that force required to separate the vapor barrier from the tip exceeds the force at least 80% of 5-year-old children can exert. More preferable exceeds the force 90% of 5-year-old children can exert and most preferably exceeds the force at least 95% of 5-year-old children can exert.

Figure 31A:
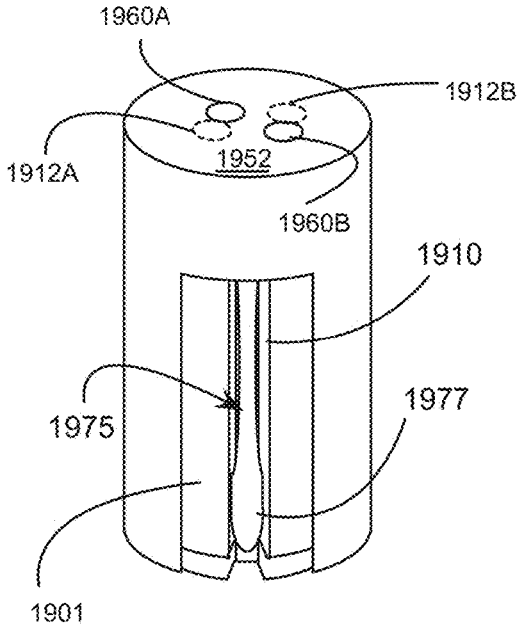
FIGS. 31A-31C illustrates a sequential rotational movement of a cap around a tip of FIG. 28 under sufficient force to rotate the cap over the tip and expose the fluid pathway for vapor from a first at rest position to a second open position and when released back to the first position.
Figure 31B:
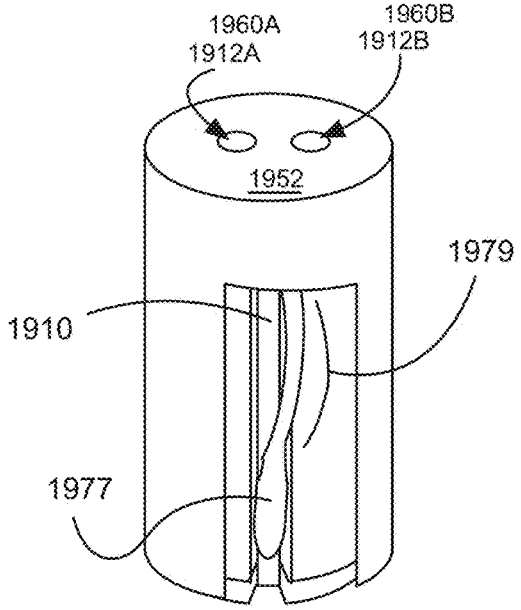
Figure 31C:
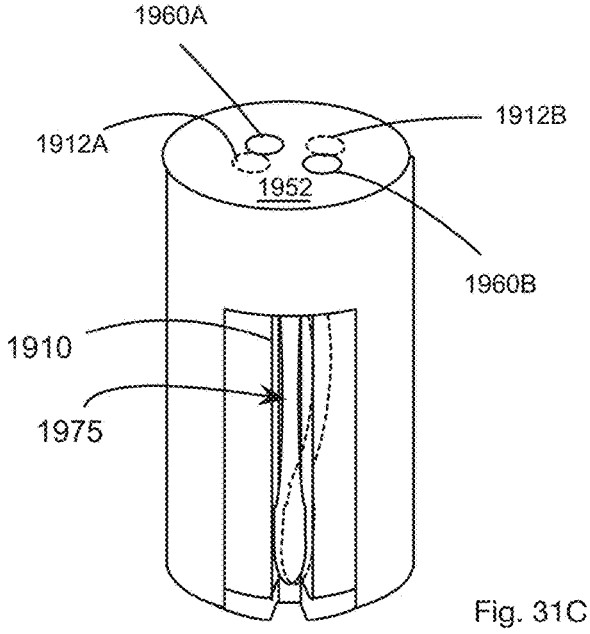

FIGS. 31A-31C illustrates a sequential rotational movement of a vapor barrier 1950 around tip 1901 to expose the vapor apertures 1912A and 1912B by away of align the barrier apertures 1960A and 1960B. Alignment is achieved by moving the vapor barrier from the first at rest position in which the apertures 1960A and 1960B are blocked to the second use position that places the barrier apertures at least partially over the vapor apertures to allow fluid flow. The rotational force requires to rotate the vapor barrier to the second position by way of displacing the torque control leg(s) 1975 is at least greater than the force 80% of 5-year-old children can apply. More preferable it exceeds the force that 90% of 5-year-old children can apply and most preferably exceeds the force that 95% of 5-year children can apply. When the force is removed the vapor barrier returns to the at rest position by way of the toque control legs.

It will be understood that various aspects or details of the disclosures may be changed combined, or removed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. A method to selective block vapor flow through a cartridge, the method comprising:

providing a vapor barrier (1520) having a body (1521), open top (1523), open bottom end (1525), flexible side walls (1506) and front and back walls (1527) forming a fluid pathway further comprising;

a first half pathway (1512) fluidly connected to a vapor inlet/pathway (130) through a distal end (120) of the vapor barrier (1520); a second half pathway (1514) fluidly connected to an inhalation outlet (1510) configured to affixed to an extract containing vaporizer cartridge (100);

a deformable valve (1515) between the first half pathway and the second half pathway in a first at rest state;

wherein squeezing the side walls of the vapor barrier with a predetermined squeeze force deforms and opens the deformable valve thereby allowing vapor produced by a cartridge fluidly connected to the vapor barrier will flow through the first and second half pathways; and, mounting the vapor barrier to the cartridge by way of a first interface formed at the bottom of the vapor barrier configured to mate with a second interface (175) formed on one of the cartridge or a cap (1800) over a portion of the cartridge.

2. The method of claim 1 wherein using the testing criteria set forth in Title 16 of the Code of Federal Rules (CFR) 1700.15 at least ninety percent of children cannot apply the predetermined squeeze force.

3. The method of claim 1 wherein using the testing criteria set forth in Title 16 of the Code of Federal Rules (CFR) 1700.15 at least ninety-five percent of children cannot apply the predetermined squeeze force.

4. The method of claim 1 wherein using the testing criteria set forth in Title 16 of the Code of Federal Rules (CFR) 1700.15 at least eighty percent of children cannot apply the force required to unmount the vapor barrier from the cartridge or cap.

5. The method of claim 1 wherein using the testing criteria set forth in Title 16 of the Code of Federal Rules (CFR) 1700.15 at least ninety percent of children cannot apply the force required to unmount the vapor barrier from the cartridge or cap.

6. The method of claim 1, the method further comprising:

placing an internal flexible scaffold (1550) within the first half pathway (1512) in a first rest position; and, wherein the predetermined squeeze force applied to the side walls temporarily deforms the flexible scaffold to a second open position.

7. The method of claim 6 wherein using the testing criteria set forth in Title 16 of the Code of Federal Rules (CFR) 1700.15 at least ninety percent of children cannot apply the predetermined squeeze force.

8. The method of claim 6 wherein using the testing criteria set forth in Title 16 of the Code of Federal Rules (CFR) 1700.15 at least ninety-five percent of children cannot apply the predetermined squeeze force.

9. The method of claim 1, the method further comprising:

placing an external force limiting fixture (1560) partially around the outside of the body (1521) configured to move from a first at rest position to a second open position when predetermined squeeze force is applied; and wherein the predetermined squeeze force applied to the external force limiting fixture temporarily deforms and opens the deformable valve.

10. The method of claim 9 wherein using the testing criteria set forth in Title 16 of the Code of Federal Rules (CFR) 1700.15 at least ninety percent of children cannot apply the predetermined squeeze force.

11. The method of claim 9 wherein using the testing criteria set forth in Title 16 of the Code of Federal Rules (CFR) 1700.15 at least ninety-five percent of children cannot apply the predetermined squeeze force.

12. A method of selective blocking and unblocking vapor flow through a tip, the method comprising:

providing a vaporizer cartridge (100) with a vapor pathway (115) fluidly connected to half outlets 1804A/B through one of the vaporizer cartridge and a cap covering a portion of the vaporizer cartridge;

affixing a vapor barrier (1850) in at first at rest position and having at least one vapor pathway (1851) to a cartridge;

blocking the half outlets by way of the vapor barrier in a first position;

apply force exceeding a predetermined force to temporarily displace the vapor barrier to a second position whereby the half outlets are unblocked forming a fluid path to the vapor pathway.

13. The method of claim 12 wherein using the testing criteria set forth in Title 16 of the Code of Federal Rules (CFR) 1700.15 at least eighty percent of children are unable to unblock the half outlets by applying sufficient force exceeding the predetermined force to displace the vapor barrier.

14. The method of claim 12 wherein using the testing criteria set forth in Title 16 of the Code of Federal Rules (CFR) 1700.15 at least ninety percent of five-year old children are unable to unblock the half outlets by applying sufficient force exceeding the predetermined force to displace the vapor barrier.

15. The method of claim 12 wherein using the testing criteria set forth in Title 16 of the Code of Federal Rules (CFR) 1700.15 at least ninety-five percent of children are unable to unblock the half outlets by applying sufficient force exceeding the predetermined force to displace the vapor barrier.

* * * * *